United States Patent [19]

Harmon et al.

[11] 4,232,456

[45] Nov. 11, 1980

[54] WEAPONS SYSTEM SIMULATOR AND METHOD INCLUDING RANGING SYSTEM

[75] Inventors: George L. Harmon; Ronald D. Monroe, both of Winter Park; Thomas M. Munday; Clarence E. Jones, both of Orlando; Edward B. Baker, Maitland, all of Fla.

[73] Assignee: Martin Marietta Corporation, Bethesda, Md.

[21] Appl. No.: 811,713

[22] Filed: Jun. 30, 1977

[51] Int. Cl.[3] ..... F41J 5/08

[52] U.S. Cl. ..... 35/25; 358/107

[58] Field of Search ..... 35/12 N, 11 R, 11 A, 35/25; 273/101.1, 101.2, DIG. 28, 102.2 B, 102.2 R; 358/93, 104, 107; 364/423, 521, 516-518, 729, 801; 340/324 AD

[56] References Cited

U.S. PATENT DOCUMENTS

| | | | |
|---|---|---|---|
| 3,218,389 | 11/1965 | Reed | 358/107 |
| 3,339,293 | 9/1967 | Kuhlo et al. | 35/25 |
| 3,376,411 | 4/1968 | Montani et al. | 364/423 X |
| 3,507,055 | 4/1970 | Claunch et al. | 35/25 |
| 3,507,990 | 4/1970 | Wolff | 35/25 |
| 3,522,667 | 8/1970 | Guillenschmidt et al. | 35/12 R |
| 3,588,237 | 6/1971 | Aldrich | 35/25 X |
| 3,610,821 | 10/1971 | Narbaits-Jaureguy | 358/107 |
| 3,653,769 | 4/1972 | Albright | 364/729 X |
| 3,701,206 | 10/1972 | Ormiston | 35/25 |
| 3,783,189 | 1/1974 | Nelson | 358/107 |
| 3,833,759 | 9/1974 | Yatabe et al. | 35/11 R |
| 3,877,157 | 4/1975 | Ashford et al. | 35/25 |
| 3,900,703 | 8/1975 | Tickle | 35/11 A X |
| 4,001,499 | 1/1977 | Dowell | 35/12 N |
| 4,055,004 | 10/1977 | Chase | 358/104 |

*Primary Examiner*—Vance Y. Hum

*Attorney, Agent, or Firm*—Burns, Doane, Swecker & Mathis

[57] ABSTRACT

A weapons simulator for training an operator in the use of a weapons system, particularly a guided missile system of the type employing operator positionable optics. The operator centers a target, having two optically detectable markers, within a predetermined field of view which is viewed through the optics. A television camera in optical communication with the optics scans the field of view and generates a first video signal representing an image including the target and the markers. The markers are detected in the video signal to generate a target signal representing the position of the target in the scanning pattern of the camera and a range signal representing the range between the simulator and the target. The operator initiates simulated flight of a missile, and an electronically generated missile signal simulates the flight of a missile. The missile signal is automatically varied in value in accordance with a guidance signal and time from initiation of flight to thereby represent the size and location of the missile within the field of view. A cathode ray tube in optical communication with the optics projects an image of the simulated missile onto the image presented to the operator, and a kill signal related to the proximity of the target is generated in response to the target, range and missile signals. Provision is made for simulating all of the sounds made by the real system, and for displaying the missile flight and other data on a TV monitor.

22 Claims, 21 Drawing Figures

| FIG. $8_1$ | FIG. $8_2$ |
|---|---|

FIG. $8_2$

FIG 10₂

| FIG 10₁ | FIG 10₂ |
|---|---|

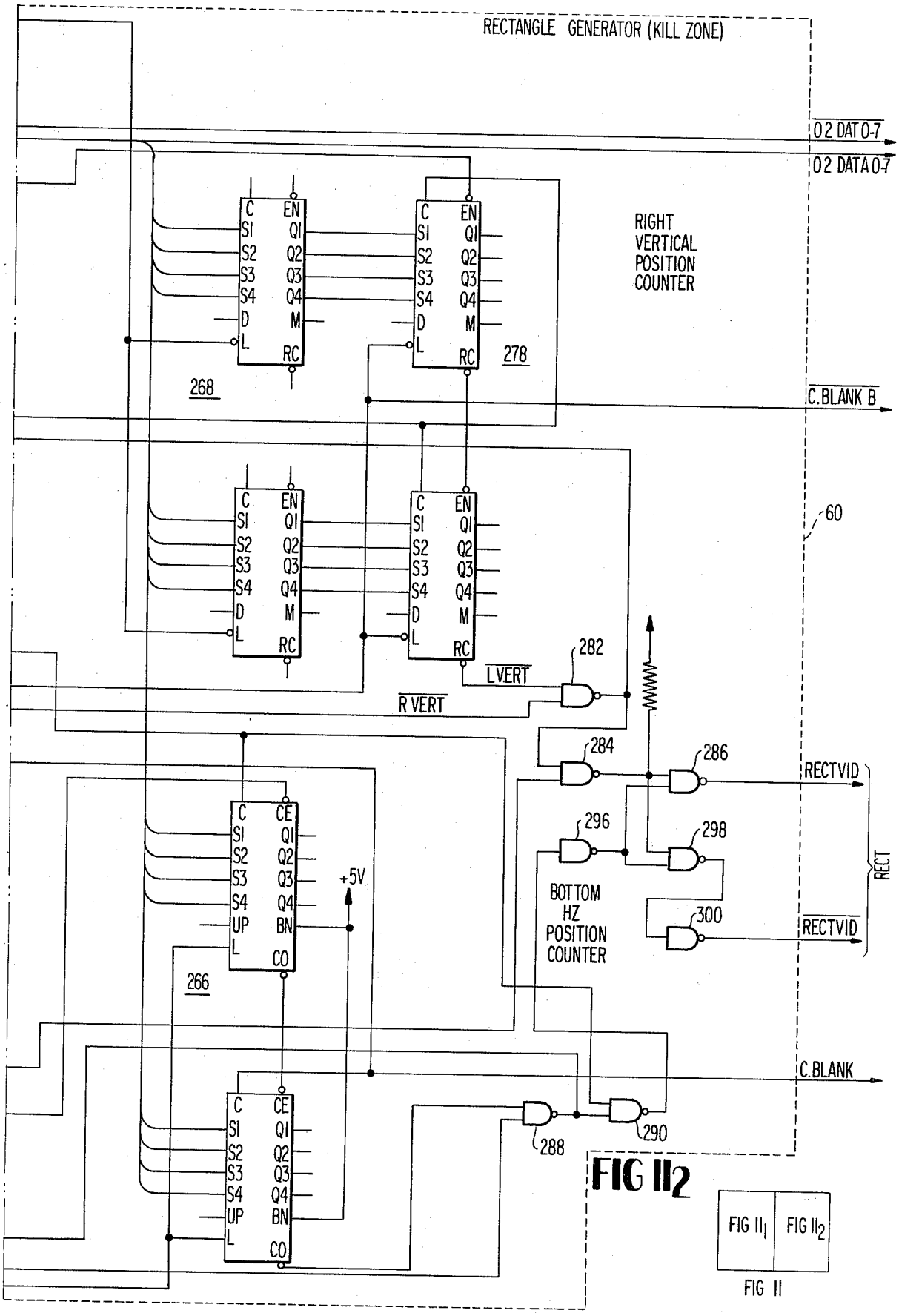
FIG II2
FIG II1 | FIG II2
FIG II

ADRS 3 STRB
5M
02 DAT 7
02 DAT 6
02 DAT 5
02 DAT 4
02 DAT 3
02 DAT 2
02 DAT 1
02 DAT 0
ADRS 1 STRB
C BLANK
ADRS 0 STRB
ADRS 2 STRB
260
262
276
280
274
272
270
264
292
294
LEFT VERTICAL POSITION COUNTER
TOP Hz POSITION COUNTER
+5V
C
EN
S1
S2
S3
S4
D
L
Q1
Q2
Q3
Q4
M
RC
UP
BN
CO
J
K
Q
R
S

02 DATA 0-7
ADRS B STRB
ADRS A STRB
302
304
306
308
310
312
62
C
CE
SI
S2
S3
S4
UP
L
Q1
Q2
Q3
Q4
BN
CO
OUT
D/A
PATCH PANEL
+5V
RANGE METER
ANALOG GND
RNGMTR
TONE FREQ.
TONE FREQ. GRD
AUD
POPS
IGNITION
AUDIO SYSTEM CONTROL

WEAPONS SYSTEM SIMULATOR AND METHOD INCLUDING RANGING SYSTEM

BACKGROUND OF THE INVENTION

The present invention relates to simulators for training personnel and, more particularly, to a weapons simulating apparatus and method for training personnel in the use of a weapons system.

Simulators are non-destructive and relatively inexpensive to operate in comparison to a real weapons systems and are therefore becoming increasingly valuable in the training of personnel in the use of weapons systems. With realistic simulation, personnel can be trained to accurately and efficiently use most systems requiring various degrees of operator skill. However, the simulation must be realistic in order to provide proper training. Moreover, the monitoring of the operator's use of the simulator is an important facet of weapons simulation since this provides a method by which the use of the simulator may be analyzed for errors.

Various simulation systems have been devised in order to improve realism and monitoring capabilities. Such simulators vary in complexity from simple mechanical systems to computer or logic controlled systems providing various stimuli designed to match the conditions of the real system. These simulators typically respond to the operator's inputs in relation to the simulator stimuli and provide data for monitoring purposes.

One known system shown in U.S. Pat. No. 3,522,667 provides a sighting device that includes a semi-reflective or beam splitting optical system that superimposes an image representing a guided missile onto the operator's optical field of view. The image is also supplied to an optical detector and to a monitoring sight for monitoring purposes. Guidance commands generated by the operator move the missile image appropriately and the result of the simulated missile firing is observed for training purposes.

In another simulator system shown in U.S. Pat. No. 3,701,206, a light image is also superimposed on the field of view as a representative of a missile fired by the simulator. Missile guidance signals are generated by determining the orientation of the launcher aiming sights through the use of gyroscopes or other means. A ranging system employing laser and electromagnetic energy provides an indication of range to the target and a timer provides an indication of missile range relative to the launcher. In this manner, the time at which the simulated missile reaches the target may be determined in order to determine aiming errors at that time and apparent decrease in the size of the missile may be simulated in accordance with missile range.

In other simulated systems such as disclosed in U.S. Pat. No. 3,691,284 and No. 3,798,796, cathode-ray tubes and television techniques are utilized to simulate a target and to monitor the operator's use of the simulator. In U.S. Pat. No. 3,798,796, for example, a television camera tube is mounted on the weapons simulator and provides the same visual image seen by the operator at a monitoring station.

Similarly, U.S. Pat. No. 3,798,795 uses a television camera for line-of-sight measurement to the target in order to calculate target position.

Typical problems encountered with prior art simulators are the lack of realism, the size and portability of the simulators, availability of a source of power to operate the simulators, and finally the cost of building and maintaining such simulators. Simulators employing computers and other complex electronic circuitry to improve realism are particularly subject to the foregoing problems and have in the past been restricted to use in controlled laboratory environments where commercial power, large computer and maintenance personnel are ever present to keep the complex apparatus in operation.

It is accordingly an object of the present invention to provide a simulator that obviates the foregoing problems of the prior art and is equally operative in field or laboratory environments.

It is yet another object of the present invention to provide a novel simulator and method for electrically and mechanically simulating a weapons system with accurate realism.

It is further object of the present invention to provide a novel method and weapons simulator that is self-contained and portable in the same manner as is the real weapons system.

It is yet a further object of the present invention to provide a novel method and missile simulating system that is economical to build with performance that closely matches the real weapons system and is reliable thereby requiring a minimum of maintenance.

These and other objects and advantages of the present invention will become apparent to one skilled in the art to which the invention pertains from a perusal of the following detailed description when read in conjunction with the appended drawings.

DETAILED DESCRIPTION

The present invention is disclosed hereinafter in relation to the simulation of command to line of sight guided missiles, such as Dragon and TOW, since the invention has particular utility in connection with this type of weapons system. However, it should be understood that various forms and aspects of the present invention may be utilized in conjunction with the simulation of other types of weapons system requiring operator training. For example, various aspects and features of the presently disclosed system may be utilized in conjunction with forward looking infrared trackers (FLIR's) or in aircraft carried weapons system environments.

Figure 1:
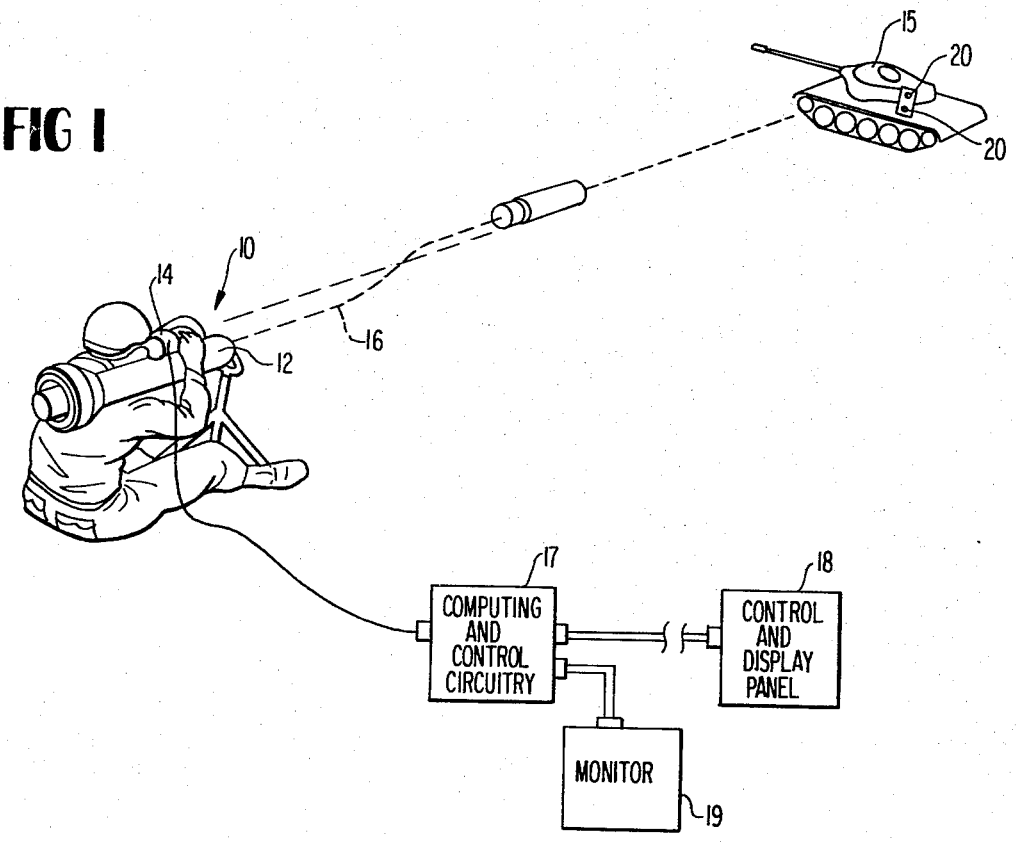
FIG. 1 is a pictorial representation of a simulator according to the invention in use.

The command to line of sight simulator shown in FIG. 1 is intended to simulate the launch and guidance of a missile as nearly as possible to its real counterpart. In this regard, both the simulator and real system comprise a hand-held assembly 10 including a launch tube 12 and an optical system 14 attached to the launch tube. In the real system, the launch tube 12 would contain a recoilless rocket or missile and the optical system might include an infrared tracker for tracking the missile and a telescope containing crosshairs for enabling the operator to see a magnified view of a target 15. In the simulator, a recoil generator or other suitable device simulates the launch of the missile for the operator's benefit, and the optical system includes additional components to provide realistic simulation and to allow for the monitoring of the operator's performance, as is described hereinafter.

In both the real system and the simulator, the assembly 10 is held steady on the shoulder of the operator and the operator sights through the optical system 14 to the target 15. In the real system, the operator then launches the missile (shown in phantom) and guides the missile to the target through commands sent to the missile along a wire 16 trailing behind the missile. The commands are generated by the infrared tracker in the optical system 14 attached to the launch tube 12 by sensing the position of an infrared flare in the aft end of the projectile. The commands are designed to keep the flare centered on the cross hairs in a tracker telescope of the optical system 14. The objective of the operator is to keep the cross hairs on the target and the infrared tracker keeps the projectile flying in line with the cross hairs thereby guiding the missile to the target.

Of course, the simulator does not actually launch a missile so it cannot track infrared flares in the missile nor can it provide the operator with a view of a real missile being guided to the target 15. The simulator of this invention therefore provides the operator with a view of a simulated missile and provides a faithful representation of what the real missile would have done as launched and guided by this particular operator.

Figure 2:
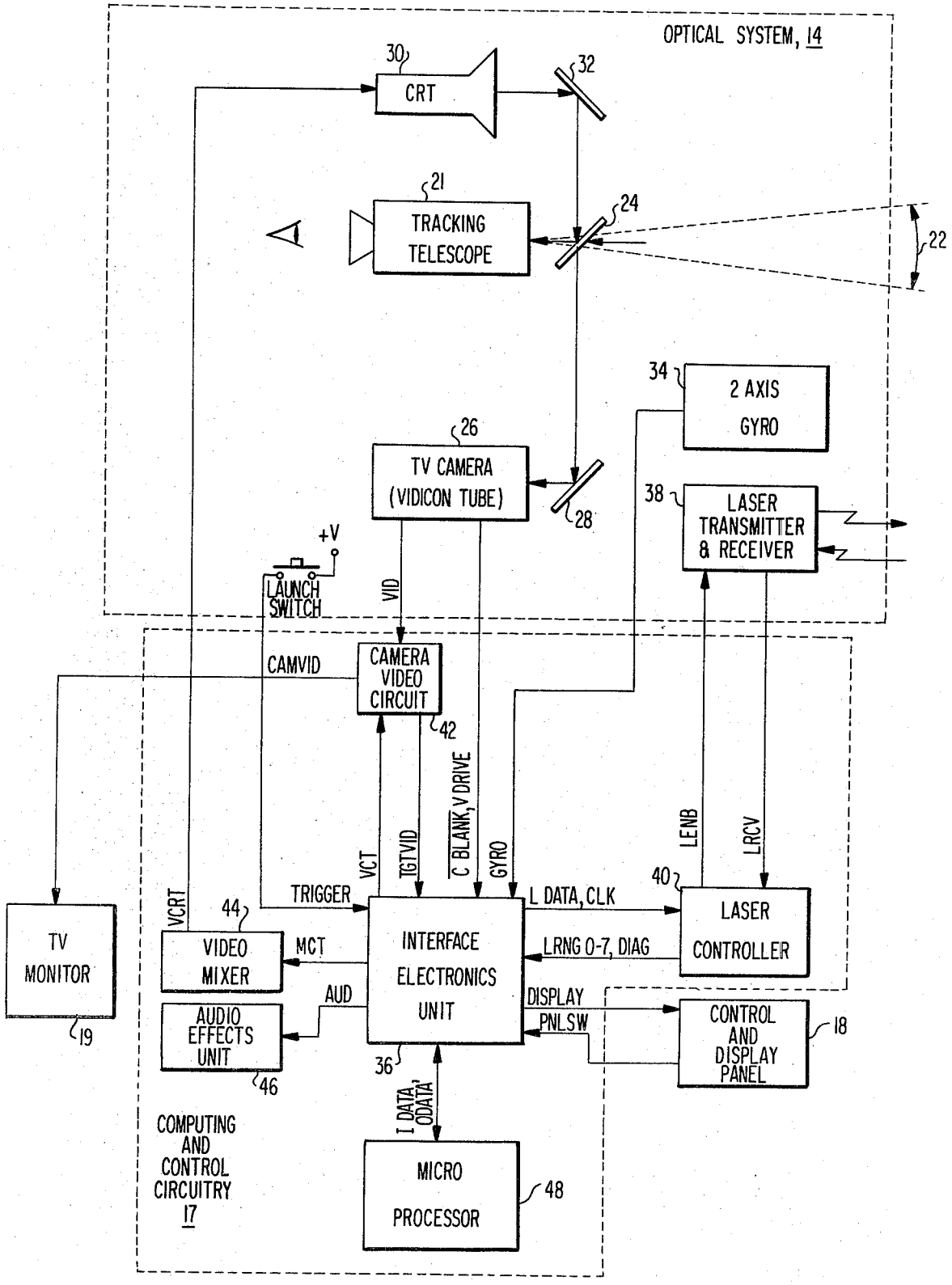
FIG. 2 is a functional block diagram illustrating a preferred embodiment of the system according to the present invention.

In order to accomplish these objectives, the simulator according to the invention includes, in the optical system 14, a television (TV) camera and a cathode ray tube (CRT), as shown in FIG. 2. The video signals from the TV camera are supplied to computing and control circuitry 17 which in turn controls the operation of the optical system and particularly the CRT so that a simulated missile is seen by the operator when the launch command is given. The computing and control circuitry 17 also supplies signals to, and receives signals from, a control and display panel 18. In addition, video signals are supplied to a monitor 19 so that the field of view seen by the operator through the optical system 14 can be displayed.

As will be described hereinafter in greater detail, at least one infrared light 20 is mounted on the target 15. This light 20 is of course not able to be seen by the operator, but is detected in the video signal operated from the TV camera and the optical system 14. The line-of-sight to the target is automatically determined by detecting the IR light signature embedded in the TV video. The continuous line-of-sight measurement permits real world evaluations of operator tracking performance and a predetermination of missile miss distance. In addition, in the preferred embodiment, two IR lights spaced a predetermined vertical distance apart are mounted on the target 15. Detection of the two lights provides data for ranging to the real target as well as of course the aforementioned line-of-sight determination.

Referring now to FIG. 2, the optical assembly 14 includes a tracking telescope 21 through which the operator (the trainee) sights the target. The tracking telescope 21 allows the trainee to observe a predetermined field of view, e.g., a 6° field, as indicated at 22. Images in the field of view 22 are received by the tracking telescope 21 through a conventional beam splitter 24 such as a partially reflective mirror. The beam splitter 24 splits the image, allowing the image to be viewed by the trainee and also reflecting the image to a conventional television camera 26 such as a vidicon tube either directly or through the use of a mirror or other reflective device 28 as shown. Similarly, the image from the face of a cathode ray tube 30 is directed onto the surface of the beam splitter 24 whether directly or by a suitable reflector 32 thereby causing reflection of the image into the tracking telescope 21.

Accordingly, the tracking telescope 21 receives the image on the face of the CRT 30 superimposed on the image in the field of view 22. The camera tube 26 may also receive both of these images (e.g., by receiving the CRT image through the beam splitter 24), but receives only the image in the field of view in the preferred embodiment. It will be appreciated that other forms of reflector and lens systems may be utilized to accomplish this result.

A conventional 2-axis gyro 34 is also provided as part of the hand-held assembly 10 in order to provide information as to movement of the hand-held device by the operator. The 2-axis gyro 34 may be attached, for example, to the launcher 12 (FIG. 1) and may supply rate signals GYRO to an interface electronics unit 36 in the computing and control circuitry 17.

In addition, a suitable conventional laser transmitter and receiver 38 is provided on the hand-held assembly 10 of the simulator or may be provided independently thereof at an adjacent location. The laser transmitter and receiver 38 may be utilized to provide information as to the range between the simulator assembly 10 and the target 15 (FIG. 1) in lieu of other range data inputs hereinafter described.

The laser transmitter and receiver 38 may be conventionally controlled by enabling signals LENB from a conventional laser controller 40 and may supply laser receiver information signals LRCB (e.g., pulse echo return information) to the controller 40 for calculation of range in a conventional manner. Appropriate data and clock signals LDATA and CLK may be provided to the controller 40 from the interface electronics unit 36, and the range information LRNG 0-7 may be supplied from the controller 40 to the interface electronics unit.

The video output signals VID from the TV camera 26 are supplied to a camera video circuit 42 and a target video signal TGTVID is supplied from the camera video circuit 42 to an interface electronics unit 36. The camera video circuit 42 also receives video control signals VCT (the electrically generated missile, cross hairs, vertical "TIC" and target kill zone signals) from the interface electronics unit 36 and combines these signals with the video signal VID to form a composite camera video signal CAMVID for use by the TV monitor 19. Camera synchronization signals CBLANK and VDRIVE (camera blanking a vertical drive signals) are also supplied from the TV camera 26 to the interface electronics unit 36.

The interface electronics unit 36 receives panel input signals PNLSW from controls on the control and display panel 18 and supplies DISPLAY output signals to the panel 18. Video mixer control signals MCT are supplied to the video mixer 44 from the interface electronics unit 36 and audio control signals AUD are supplied to an audio effects unit 46. The video mixer supplies video signals VCRT to the cathode ray tube 30 of the optical tracker assembly.

A conventional microprocessor 48 receives input data IDATA from the interface electronics unit 36 and supplies output data ODATA thereto to control the operation of the simulator. The control and display panel 18 operates through the interface electronics unit 36 to provide operator control of the system and displays of various functions.

In operation, and with reference to FIGS. 1 and 2, the trainee attaches the optical system 14 to the launch tube 12 as in the real system and positions himself ready to fire. He then locates the target 15 in the tracking telescope 21 and centers the target in the tracking telescope with the aid of cross hairs that are provided in the tracking telescope. Vertical "TIC" marks having a predetermined spacing are also provided in the tracking telescope. The "TIC" marks are used by the operator to estimate range to the target and, in general, indicate to the operator that a tank is in range if it fills the space between marks.

When the cross hairs are centered on the target, the trainee depresses a trigger on the assembly 10 and the system then simulates the flight of a missile to the target. Depression of the trigger starts the operation of the system and the microprocessor 48 operates through the interface electronics unit 36 to electronically generate missile video signals. The electronic missile video is supplied through the video mixer 44 to the cathode ray tube 30 as the VCRT signal to form an image of the missile that is superimposed on the operator's field of view by the reflective surface of the beam splitter 24. The operator thus sees the image of the simulated missile, launched and in flight toward the target.

The two infrared (IR) lights 20 mounted on the target 15 at a predetermined vertical spacing are detected by the TV camera 26 but are not seen by the trainee. In this connection, the TV camera 26 may be of the type having a greater than ordinary sensitivity to light in the IR spectrum. The TV camera 26 supplies this video information to the camera video circuit 42 where the IR data is separated from normal camera video. The IR data (the target video signal TGTVID) is supplied to the interface electronics unit 36 and both range to the target and target position in the field of view are computed in response to the IR data as will hereinafter be described in greater detail. The normal camera video VID is combined with the VCT signals to produce the signal for application to the TV monitor 19.

The microprocessor 48 continues to receive range information and target position (in response to the infrared lights) as well as tracker motion (in response to the 2-axis gyro output signals). Missile size in continuously computed and the missile image is modified in accordance with the distance of the electronic missile from the launcher (e.g., in response to the time of flight). Missile motion is also computed in response to the motion of the tracker, i.e., the gyro signals. Missile video signals are generated in response to the size and position data and are supplied to the video mixer 44 for display by the CRT and to the camera video circuit 42 for mixing with the camera video VID.

When the missile has flown long enough to cover the range computed to the target, the microprocessor 48 determines if the missile is in the kill zone in response to the target position data (i.e., the position of the infrared lights) and the position of the missile in the field of view. If the missile is in the kill zone, a hit is scored and the cathode ray tube 30 is flashed to simulate a hit. If the missile is outside the kill zone, no hit is scored and the miss distance is computed. The simulator simulates the continuous flight of the missile until it impacts the ground in the event that a kill is not scored.

The audio effects unit 46 provides simulation of the sounds made by the missile when it is launched and as it is being guided. For example, a series of loud pops representing the small thrusters firing on the real missile are provided as the missile is guided toward the target. This simulates the sound of a real missile wherein thrusters fire to give lateral, vertical and flight path velocity control over the missile during its flight. The vertical and lateral thrusters are, of course, the guidance input to the real missile system. Accordingly, the guidance system signals generated by the microprocessor 48 in response to signals from the 2-axis gyro are utilized to control the position of the electronically generated missile as well as to control the thruster sounds made by the audio effects unit 46.

The laser transmitter and receiver 38 is provided as an alternative method of computing range between the tracker and the target. Similarly, range may be manually supplied to the microprocessor 48 from a manual range set control on the control and display panel 18. The display of that which is being viewed by the trainee as well as additional displays of data may be provided on the TV monitor as will hereinafter be described in greater detail.

The audio system may also provide another output not possible in the real weapon system. An error tone may be generated and supplied through the audio unit 46 to provide the trainee with an indication of aiming error. This tone may, for example, increase in frequency as the trainee aiming error increases.

During the launch and flight of the simulated missile, the video signal from the TV camera is supplied to a conventional TV monitor so that the proficiency of the operator may be monitored. The video signal from the TV camera is combined with an electronically generated cross hairs signal, electronically generated "TIC" marks, the missile video signal, and a kill zone signal so that the monitoring personnel can watch the flight of the simulated missile toward the target, as seen by the operator, as well as judge the miss distance (i.e. whether or not the simulated missile is in the kill zone when the missile reaches the target). Thus, the entire simulated flight of the missile, as seen by the operator through the tracking telescope, can be monitored from a remote location with additional information provided in order to judge the operator's performance.

Ranging

Figure 3:
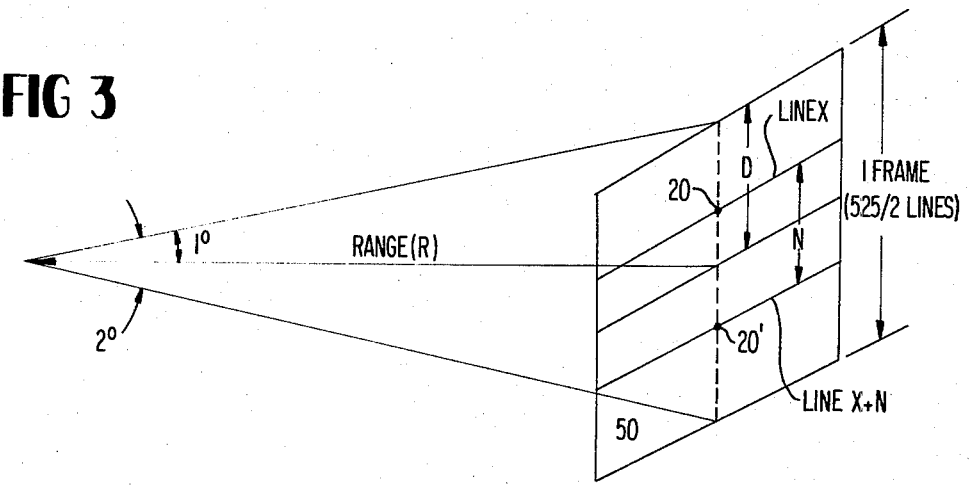
FIGS. 3 and 4 are diagrams illustrating the respective operations of the TV ranging systems and the TV display system in accordance with the present invention.

To facilitate an understanding of the manner in which ranging is preferably accomplished in accordance with the present invention, FIG. 3 diagramatically illustrates one frame of TV video as received by the TV camera 26. While the optical tracker preferably has a 6° optional field of view, the TV camera 26 in the illustrated embodiment has an optical system with a 2° field of view. As will be appreciated, the farther the target 15 is located from the optical system 14, the closer together the two IR lights 20 will appear on the face of the TV camera tube (and vice-versa). Accordingly, the system determines the vertical distance between the images of the IR lights 20 on the face of the TV camera tube (i.e., the vertical spacing in the scanning pattern of the camera tube) to determine target range.

As can be seen in FIG. 3, the TV camera scans about 262 lines (525/2) in one TV frame covering the entire face 50 of the camera. The camera tube scans the image on the face 50 thereof and detects the first (uppermost) of the two IR lights 20 on the scan line X. A counter is started and the number of scan lines N is counted between the first detected light and the second detected light 20 (on scan line X+N).

From FIG. 3, it will be appreciated that the tangent of 1° is equal to the dimension D (the distance between the first scan line and the centermost scan line) divided by the range R to the target. This may be expressed mathematically by the equation:

$$\text{TAN } 1° = D/R \qquad \text{(equation 1)}$$

It will also be appreciated that the distance D is equal to 525/4 lines and that the spacing between the lights (assuming one meter spacing on the target) can be expressed in terms of scan lines by the relationship:

$$D/525/4 = 1 \text{ meter}/N \qquad \text{(equation 2)}$$

$$D = 525 \text{ meters}/4N \qquad \text{(equation 3)}$$

By substitution of D from equation 3 into equation 1, $$\text{TAN } 1° = 525/4NR \qquad \text{(equation 4)}$$

$$R = 525 \text{ meters}/4N(\text{TAN } 1°) \qquad \text{(equation 5}$$

Accordingly, the only two unknowns in equation 5 are the target range R and the number of scan lines N between the images of the IR lights 20. By detecting the first light and counting the number of scan lines until detection of the second light, the quantity N can be determined and equation 5 solved for target range R.

As will be appreciated by one skilled in the art, any suitable conventional level detector may be employed to detect the images of the IR lights in the scanned video. These lights will show up in the camera video signal VID as high level pulses and can be readily detected by a level detector in the camera video circuit 42 to produce the target video signal TGTVID containing the desired information regarding the locations of the IR lights in the TV camera scanning pattern. It should be noted in this connection that each light may appear on more than a single scan line (i.e., two or more adjacent scan lines) so the circuit used to stop the line counter when the second light is detected may be disabled for three or four scan lines after detection of the first light 20 as will be described in greater detail hereinafter.

Interface Electronics Unit

Figure 4:
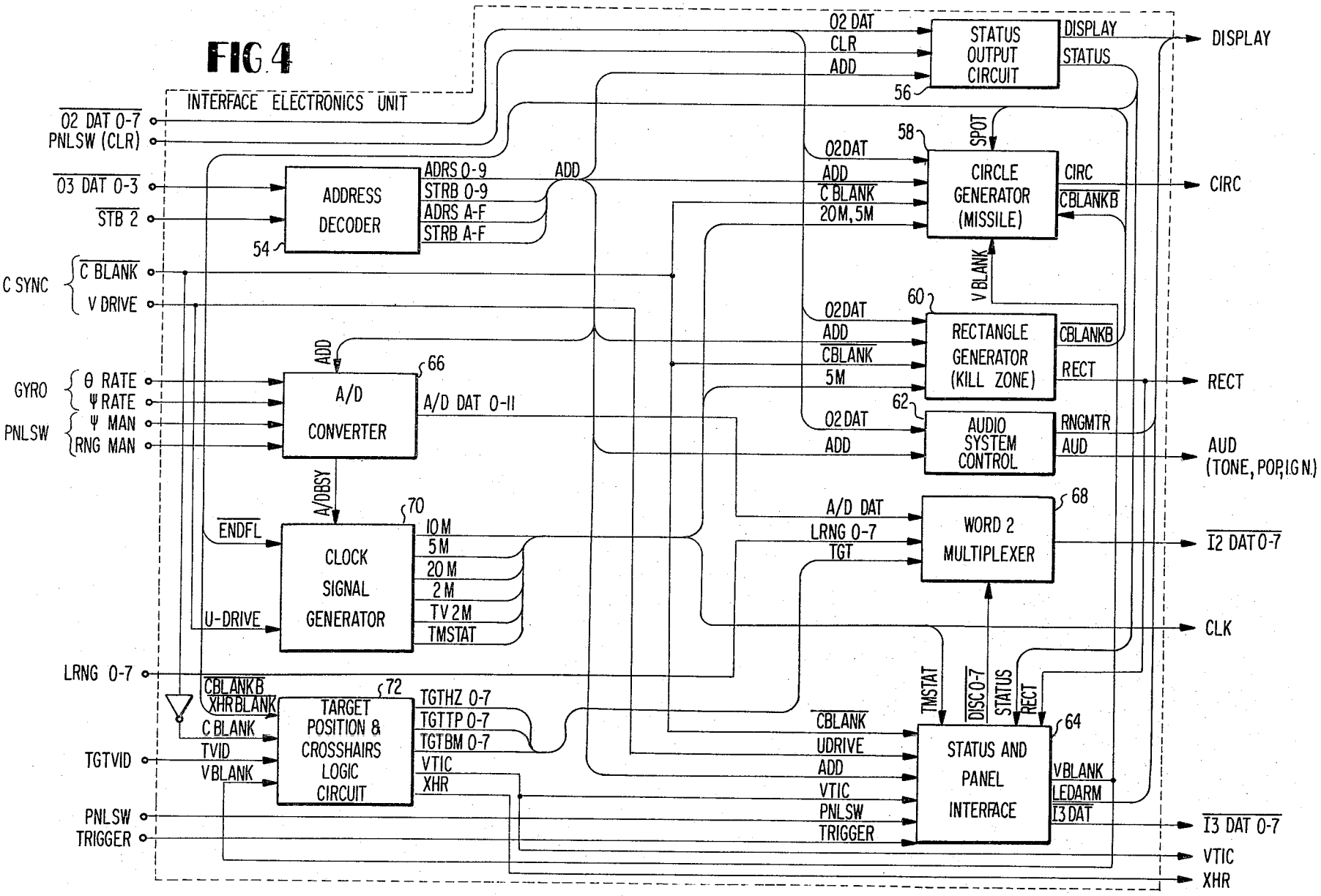

To aid in an understanding of the invention, the interface electronics unit 36 of FIG. 2 is illustrated in greater detail in FIG. 4. Referring now to FIG. 4, a 4-bit address word $\overline{03}$DAT0-3 from the microprocessor 48 is supplied to an address decoder 54 together with a strobe signal $\overline{\text{STB2}}$ indicating that the address word is available for decoding. The decoded output signals ADD (including the ADRSO-9, STRBO-9, ADRSA-F and STRBA-F signals) from the address decodes 54 are supplied to a status output circuit 56, a circle generator 58, a rectangle generator 60, an audio system control 62 and a status and panel interface circuit 64. A data signal $\overline{02}$DAT0-7 from the microprocessor 48 is supplied to each of the circuits 56–62.

The pitch gyro signal $\theta$ RATE and the yaw gyro signal (ΨRATE) are supplied as the GYRO signal from the 2-axis gyro 34 to an analog to digital (A/D) converter 66 together with a manual yaw gyro signal ΨMAN and a manual range signal RNGMAN supplied as part of the PNLSW signal from the control and display panel 50. The output signal A/D DAT0-11 from the analog to digital converter 66 is supplied to a multiplexer 68. A busy output signal A/D BSY is also supplied from the A/D converter 66 to a clock signal generator 70. The clock signal generator 70 also receives an end of flight signal $\overline{\text{ENDFL}}$ from the status output circuit 56 and supplies clock signals CLK including the 2, 5, 10 and 20 megahertz signals 2M, 5M, 10M and 20M as well as a 2 megahertz TV signal TV2M and a timing status signal TMSTAT for application to the circle and rectangle generators 58 and 60, the interface 64 and as the clock output signal CLK as shown.

The target video signal TGTVID separated from the camera video signal VID by the camera video circuit 42 of FIG. 2 is supplied to a target position and cross hairs logic circuit 72 along with the inverted $\overline{\text{CBLANK}}$ sync signal from the camera. The camera sync signals $\overline{\text{CBLANK}}$ and VDRIVE are both supplied to the status and panel interface 64 and the $\overline{\text{CBLANK}}$ signal is supplied to the circle and rectangle generators 58 and 60. The VDRIVE camera signal is also supplied to the clock signal generator 70.

The target position output signals TGT (including horizontal TGTHZ0-7, top TGTTP0-7 and bottom TGTBM0-7 position signals) from the target position logic circuit 72 are supplied to the multiplexer 68. The electronically generated vertical "TIC" signal VTIC is supplied from the logic circuit 72 to the status and panel interface circuit 64 and as an output signal to the video mixer 44 of FIG. 2. The cross hair signal XHR is provided as an output signal for use by the video mixer 44 and the camera video circuit 42 as previously described. In this connection, it should be noted that the electronically generated cross hairs and vertical "TIC" marks are preferably supplied to the video mixer for use by the CRT 30 only for calibration purposes and not when the system is in use for training purposes.

The status output circuit 56 receives the clear signal CLR from the control and display panel switches (PNLSW) and supplies the DISPLAY signals to the control panel 18 (FIG. 2). The audio system control 62 and the panel interface 64 supply the respective range meter signal RNGMTR and the arm indicator signal LEDARM to the control panel 18 as part of the DISPLAY signal. The status output circuit 56 also supplies a status signal STATUS to the circle generator 58 (SPOT), to the clock signal generator 70 ($\overline{\text{ENDFL}}$), to the logic circuit 72 ($\overline{\text{XHRBLANK}}$) and to the status and panel interface circuit 64 (INFL, $\overline{\text{ENDFL}}$).

The circle generator 58 generates the circle signals CIRC that control the generation of the circle or missile video by the cathode ray tube 30 (FIG. 2). The circle signals are supplied to the video mixer 44 and to the camera video circuit 42 as was previously described in connection with FIG. 2.

The rectangle generator 60 generates the rectangle signal RECT that defines the kill zone in which the target is considered to be struck by the simulated missile if the missile passes there through when it has been in flight long enough to reach the target. The rectangle signal RECT is supplied to the camera video circuit 42 of FIG. 2 as part of the VCT signal for generation of the camera video signal CAMVID that is supplied to the TV monitor 19. The RECT signal is also supplied to the status and panel interface 64. In addition, the rectangle generator supplies a blanking signal $\overline{\text{CBLANKB}}$ to the circle generator 58.

The audio system control 62 generates the control signals AUD that control the audio effects unit 46 of FIG. 2. Specifically, the missile thruster and ignition sounds POP and IGN are commanded by the AUD signal. The frequency of the aiming error sound TONE is also commanded by the AUD signal. In addition, the audio system control converts range data to analog form to supply the analog target range signal RNGMTR as part of the DISPLAY signal to a range meter on the control and display panel 18 of FIG. 2.

The word 2 multiplexer 68 time multiplexers the target position data TGT, the gyro (tracker movement) data, the discrete command data, and the laser range data and supplies this data in timed sequence to the microprocessor 48 of FIG. 2. The microprocessor uses this data to compute the electronic missile size and location, target location, the timing and nature of audio effects, the size and location of the kill zone, the status of the simulator system, miss distance, etc. The microprocessor 48 provides data as to the computed values in the form of the data word $\overline{\text{02DAT0-7}}$ which is supplied to the interface electronics unit 36.

The status and panel interface circuit 64 receives panel switch data PNLSW and other status data and supplies it to the multiplexer 68 in the form of the discrete data word $\overline{\text{DISC0-7}}$. Data such as the panel switch data is also supplied to the microprocessor 48 as the I3 input data word $\overline{\text{I3DAT0-7}}$. A vertical blanking signal VBLANK and an arm indicator signal LEDARM are also generated for use by the interface electronics unit circuits 58, 72 and the control panel 18, respectively.

In operation, the TRIGGER signal from the launch switch in the optical system of FIG. 2 is supplied to the status and panel interface 64 when the trainee depresses the launch trigger on the hand held optical system 14. Depression of the launch switch commences the simulation by the computing and control circuitry 17.

Specifically, the status and panel interface 64 generates an input data signal which is supplied to the microprocessor 48 to initiate missile launch simulation. The microprocessor 48 supplies output data to the address decoder 54 and to the various circuits in the interface electronic unit. In response to the address signals, the address decoder 54 initiates the generation of the electronic missile signal CIRC that effects the display of the missile as well as the kill zone or RECT signal. The circle signal CIRC is supplied to the CRT 30 and TV monitor 19 of FIG. 2 to simulate the flight of a missile. In addition, the kill zone or RECT signals, together with the verticle TIC signals VTIC, are supplied to the TV monitor 19 along with the cross hairs signal XHR in order to provide an image on the TV monitor 19 identical to that seen by the trainee with the addition, of course, of the kill zone display which is not seen by the trainee.

The audio system control 62 generates the appropriate audio signals upon launch and during the flight of the missile as was previously mentioned. The target position and cross hairs logic circuits 72, in addition to generating the cross hair and vertical TIC signals, generates the target position signals which represent the horizontal position of the target in the television scan (TGTHZ), the position of the top of the target (TGTTP), and the position of the bottom of the target (TGTBN). The position signals relating to the horizontal, top and bottom positions of the target represent the corresponding positions of the uppermost and lowermost infrared lights (mounted on the target) relative to the scan pattern of the TV camera (e.g. relative to the edges of the TV image). This target position data, along with the digital gyro signals from the analog to digital converter 66, are multiplex and fed to the microprocessor in order to determine target range and the position of the missile relative to the kill zone.

In this connection, it should be noted that the target range is calculated as was previously described in connection with FIG. 3. The target kill zone (RECT) is a rectangle whose upper and lower sides pass through the respective top and bottom infrared lights on the target. The length of the rectangle is preferably about three times its width (i.e. three times the distance between the lights as the lights appear in the scanned field of view) and the target is centered within this rectangle. This missile miss-distance is thus calculated by the microprocessor by determining whether or not the circle video (the simulated missile) passes through the kill zone when the simulated missile reaches the target (as determined by target range and missile flight time).

As will be seen hereinafter, the logic circuits in the interface electronics unit operate in response to eight-bit data words from the microprocessor 48 and supply data to the microprocessor 48 as eight-bit words. In this connection, the microprocessor is preferably a commercially available Intel Model MDS-800 with 32,000 words of semi-conductor memory. Non-volatile program storage is provided in a conventional manner by a floppy disc, and a conventional teletypewriter provides operator communication with the system and hard copy printouts when needed. The teletypewriter may also provide limited capability to read and punch paper tape.

In the preferred embodiment, the microprocessor 48 is connected to the interface electronics unit 36 by way of a standard two-way, four channel external input/output data interface module. Two of the four output channels are used for output data from the microprocessor (02 and 03 data words) and two of the four input channels are used for input data to the microprocessor (I2 and I3 data words). The other channels are used for initial program load and display purposes.

Address Decoder

Figure 5:
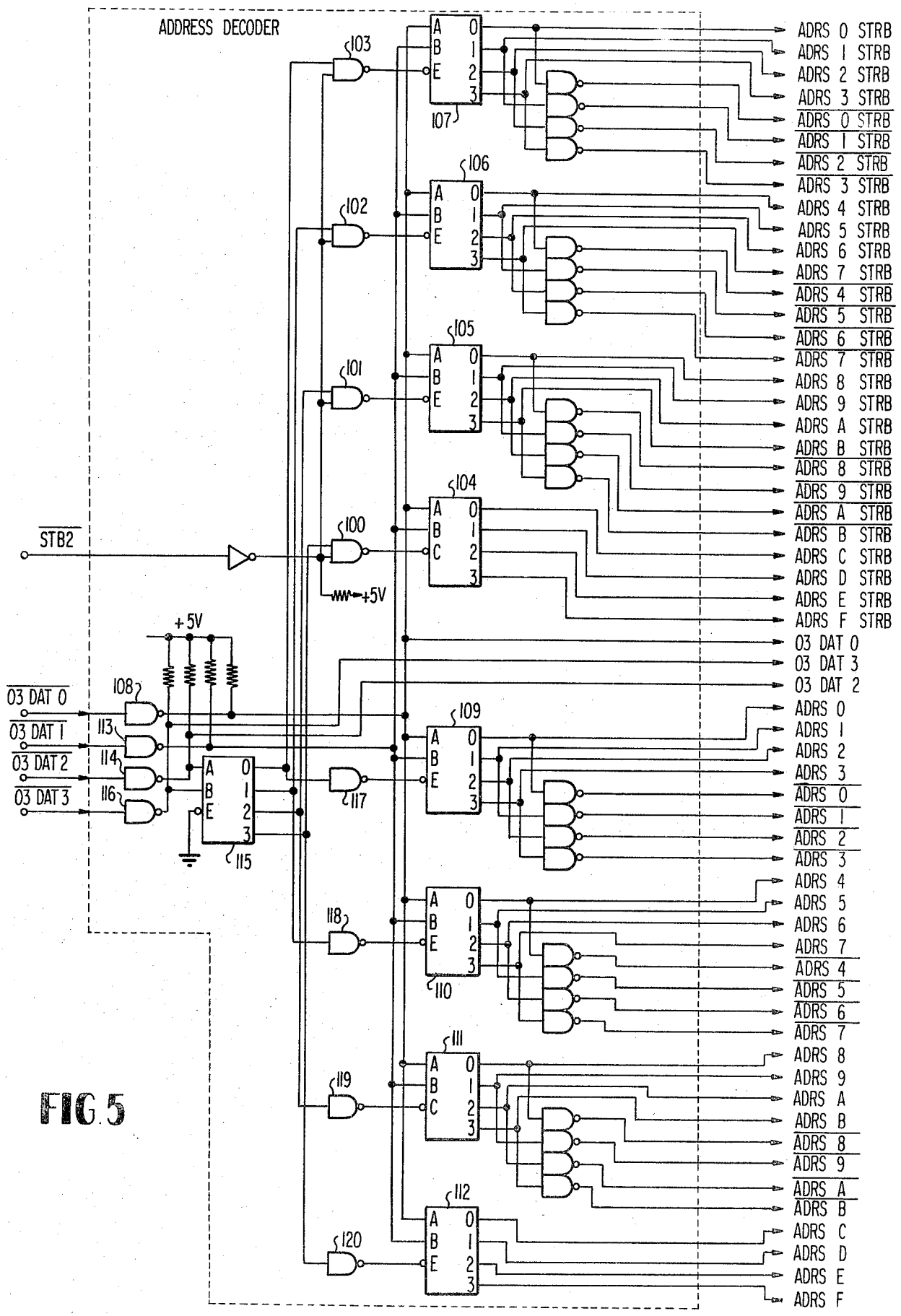
FIG. 5 is a functional block diagram illustrating the interface electronics of FIG. 2 is greater detail.

The address decoder 54 of FIG. 4 is illustrated in greater detail in FIG. 5 to facilitate an understanding of the present invention. Referring now to FIG. 5, the strobe signal $\overline{\text{STB2}}$ is applied through an inverter to one input terminal of each of a plurality of NAND gates 100–103. The output signals from each of the NAND gates 100–103 is supplied to the enable input terminal E of respective two line decoder (e.g. binary to one of four decoders) 104–107 and various address strobes, together with their inverted versions, are produced by the decoders 104–107 as indicated. The address strobes are utilized throughout the interface electronic unit to strobe data into the various logic circuits for generation of control and video signals and the like as will be seen hereinafter.

The first bit of the 03 data word ($\overline{\text{03DAT0}}$) is inverted through an inverter 108 and is applied to the data A input terminal of each of the decoders 104–107 as well as to the data A input terminal of each of a plurality of two line to four line decoders 109–112. The output signals from the decoders 109–112, and their inverted forms, are supplied as the address output signals for use by the other circuits of the interface electronics unit as is described hereinafter.

The $\overline{03DAT1}$ signal from the microprocessor is supplied through an inverter 113 to the data B input terminal of each of the decoders 109–112. The $\overline{03DAT2}$ signal from the microprocessor is supplied through an inverter 114 to the A input terminal of a two line to four line decoder 115 and the $\overline{03DAT3}$ signal is supplied from the microprocessor through an inverter 116 to the B input terminal of the decoder 115. The output signal from the "0" output terminal of the decoder 115 as applied to the other input terminal of the NAND gate 103 and through an inverter 117 to the enable input terminal of the decoder 109. The output signal from the "1" terminal of the decoder 115 is applied to the second input of the NAND gate 102 and through an inverter 118 to the enable input terminal of the decoder 110. The output signal from the "2" output terminal the decoder 115 is applied to the second input terminal of the NAND gate 101 and through an inverter 119 to the enable input terminal of the decoder 111. The output signal from the "3" output terminal of the decoder 115 is supplied to the other input terminal of the NAND gate 100 and through an inverter 120 to the enable input terminal of the decoder 112.

In operation, the address decoder receives the four least significant bits of the 03 output data word from the microprocessor 48 of FIG. 2 and decodes these four least significant bits into sixteen discrete addresses as well as corresponding address strobes. Data enters through the inverters 108–113, 114 and 116 and is decoded by the array of two line to four line decoders 104–107 and 109–112.

The address decoder provides an output signal which is present the entire selected address time. Also, provided is a strobe signal for each selected address, which strobe occurs when output data word 02 from the microprocessor 48 is valid. The strobe is used by the addressed logic circuit to gate in the data applied thereto. As will be appreciated by one skilled in the art, the addressing scheme is unique in that the microprocessor also selects input data (e.g. target location or gyroscope data in the form of the I2 data word) through this same address decoder. For example, when address "3" (ADRS 3) is selected, the microprocessor 48 outputs data to the kill zone generator (the rectangle generator) and inputs data from the gyroscope through the analog to digital converter 66.

The following table sets forth the relationships between the addresses produced by the address decoder 54 and both the output and input data types. The input data word is, of course, supplied to the microprocessor 48 while the destination of data in the 03 output data word is set forth in parenthesis after the data type.

TABLE I

| DATA WORD # | INPUT | OUTPUT | I/O ADDRESS |
|---|---|---|---|
| 0 | I/O to MICRO | MICRO to I/O | 10 |
| 1 | I/O to MICRO | MICRO to I/O | 11 |
| 2 | Simulator to MICRO (data) | MICRO to Simulator (data) | 12 |
| 3 | Simulator to MICRO (Status) | MICRO to Simulator (address) | 13 |

ADDRESS CODES FOR WORD 3

| Output Data Type | CODE (HEX) |
|---|---|
| Target rectangle top horizontal line position | 0 |
| Target rectangle left vertical line position | 1 |
| Target rectangle vertical size | 2 |
| Target rectangle horizontal size | 3 |
| Spot horizontal diameter left start position | 4 |
| Spot horizontal diameter top start position | 5 |
| Spot size | 6 |
| Spare | 7 |
| Discrete register (Status) | 8 |
| LED Display | 9 |
| Audio control word | A |
| Range value | B |
| Selectable variable | C |
| Spare | D |
| Spare | E |
| Spare | F |
| **Input Date Type** | **CODE (HEX)** |
| Spare | 0 |
| Target location horizontal position counter | 1 |
| Target location top horizontal line count | 2 |
| Tube rate $\theta$ MSB (analog) | 3 |
| Tube rate $\theta$ LSB (analog) | 4 |
| Target location bottom horizontal line count | 5 |
| Tube rate $\psi$ MSB (analog) | 6 |
| Tube rate $\psi$ LSB (analog) | 7 |
| Discrete date | 8 |
| Manual range | 9 |
| **Input Data Type** | **CODE (HEX)** |
| Laser range | A |
| Spare analog (analog) | B |
| Spare | C |
| Spare | D |
| Spare | E |
| Spare | F |

Analog To Digital Converter

Figure 6:
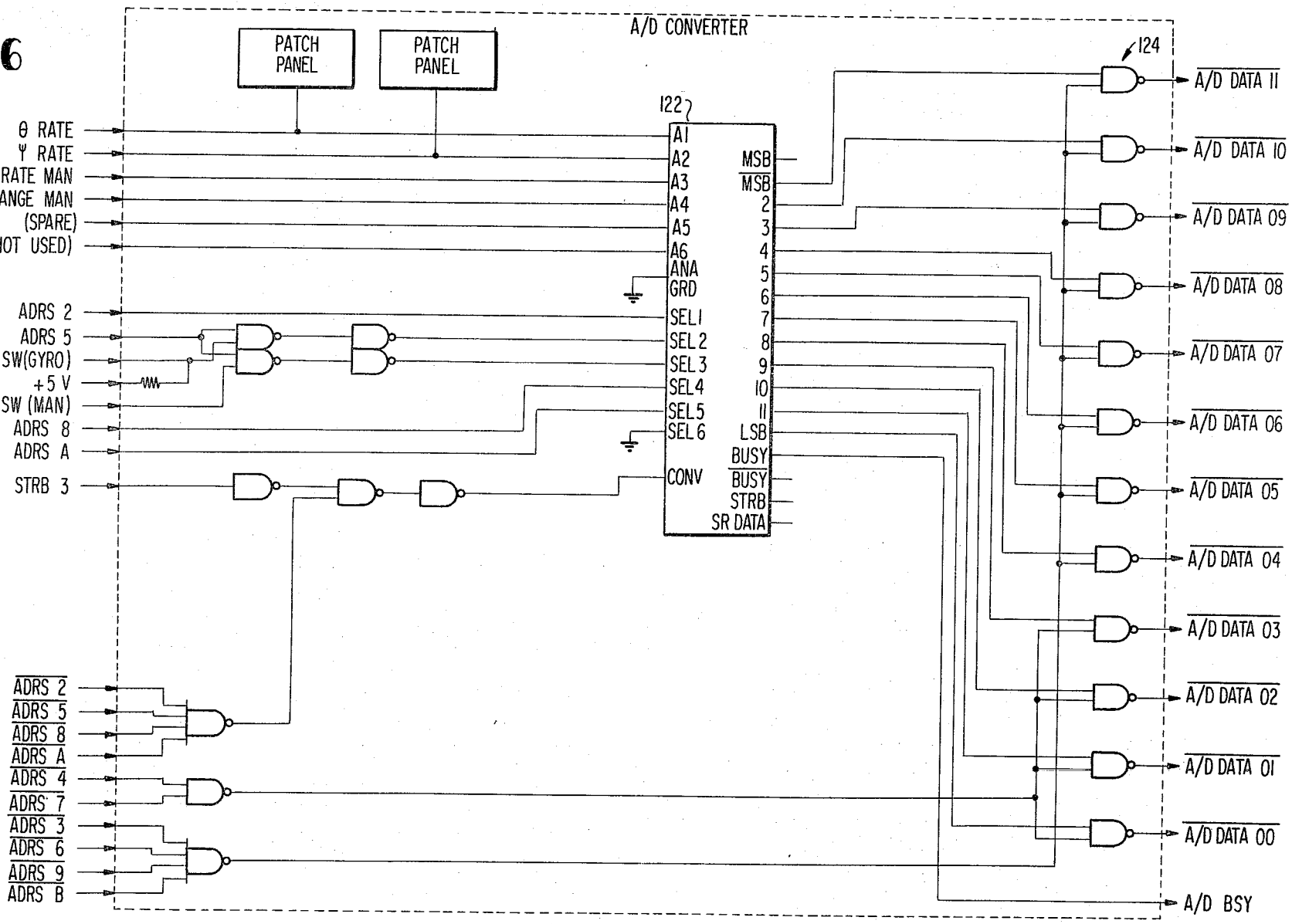
FIGS. 6–17 are detailed circuit and block diagrams illustrating the circuit elements of FIGS. 2 and 4 in greater detail.

The analog to digital (A/D) converter 66 of FIG. 4, may be any suitable conventional 12-bit converter arranged, for example, as illustrated in FIG. 6. Referring to FIG. 6, analog input signals, including the gyro signals $\theta$RATE and $\Psi$RATE and the manual gyro and range signals from the control panel, are supplied to the analog input terminals A1–A6 of a 12-bit analog to digital converter 122 (e.e. an Analog Devices model ADC-12QZ-003). These signals are selected for conversion to digital form in response to signals supplied to the corresponding select input terminals SEL1–SEL6.

In this connection, the address signals generated by address decoder, together with the gyro switch signals from the control panel, perform the selection of the input data to be converted to digital form. The STB3 signal from the microprocessor 48 triggers the A/D converter 122 to cause the conversion of the selected data to be performed. The output signals from the A/D converter are selectively gated through a plurality of NAND gates generally indicated at 124 in response to various ones of the ADRS signals as illustrated. The NAND gates 124 thus selectively provide the 12 output signals A/D DATA that are supplied to the microprocessor.

In operation, the analog inputs of the A/D converter are selectively addressed by the microprocessor 48 through the address decoder 54 (FIG. 4). Five of the six analog inputs are addressed and four are used for analog input data as shown.

The address decoder, acting upon data from the microprocessor, selects which analog data will be converted and transferred through the multiplexer 68 (FIG. 2) to the microprocessor. The A/D output is a 12-bit digital word which is thus selectively entered into the microprocessor through the multiplexer under the control of the 03 data word (see, e.g. TABLE I).

Clock Signal Generator

The clock signal generator 70 of FIG. 4 may be any suitable conventional timing circuit constructed to provide the various timing or clock signals required by the interface electronics unit logic circuits and the television circuits. One embodiment of a suitable clock signal generator is illustrated in greater detail in FIG. 7.

Figure 7:
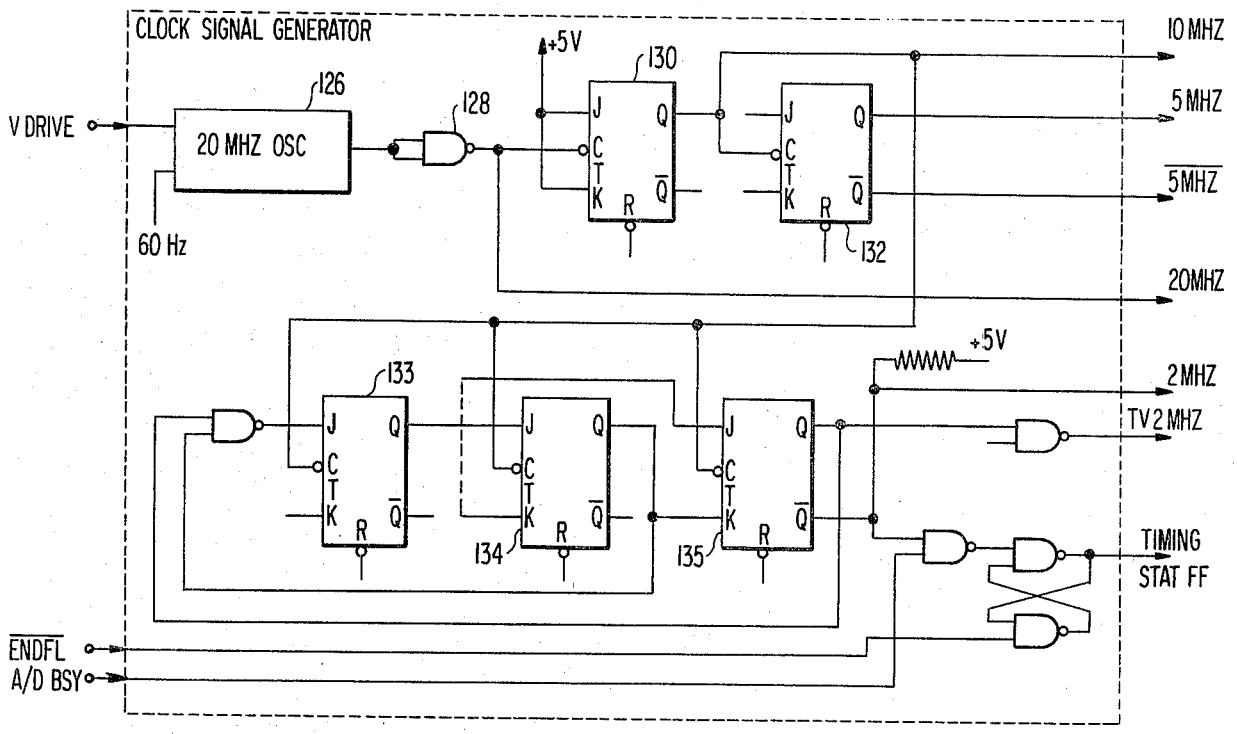

Referring now to FIG. 7, the vertical driver signal VDRIVE from the TV camera 26 of FIG. 2 is applied to a control input terminal of a conventional 20 MHz oscillator 126 and a 60 Hz signal (e.g. line frequency) is applied to a synchronization input terminal. The 20 MHz output signal from the oscillator 126 is applied through an inverter 128 to the clock input terminal of a J-K flip flop 130 and as the 20 MHz (20M) clock output signal.

The flip flop 130 divides the 20 MHz signal in half to produce the 10 MHz (10M) signal which is further divided by a flip flop 132, as illustrated, to produce the 5M and $\overline{5M}$ signals. The 10M signal is also further divided by flip flops 133–135 arranged in a modulo 5 counter configuration to produce the 2M, TV2M and TMSTAT signals. The A/D BSY signal from the A/D converter 66 and the ENDFL signal from the status output circuit (FIG. 4) control the generation of the TMSTAT signal as illustrated. This provides a diagnostic bit which is displayed as a discrete bit on the control panel.

Target Position & Cross Hairs Logic Circuit

The target position and cross hairs logic circuit 72 of FIG. 4 processes the infrared target video information TGTVID from the camera video circuit 42 of FIG. 2), and determines the location of the infrared lights (the target) with respect to the edges of the TV picture, i.e. the vertical and horizontal location of the target in the scan pattern of the TV camera. In addition, the logic circuit 72 generates the cross hair signals XHR(MON), XHR(CRT) supplied to the respective camera video circuit 42 and video mixer 44 of FIG. 2 for generation of the electronic cross hairs on the TV monitor 19 and the CRT 30. Also, the vertical "TIC" signal VTIC that generates the vertical TIC marks for the TV monitor is generated by the logic circuit 72.

Figure 8A:
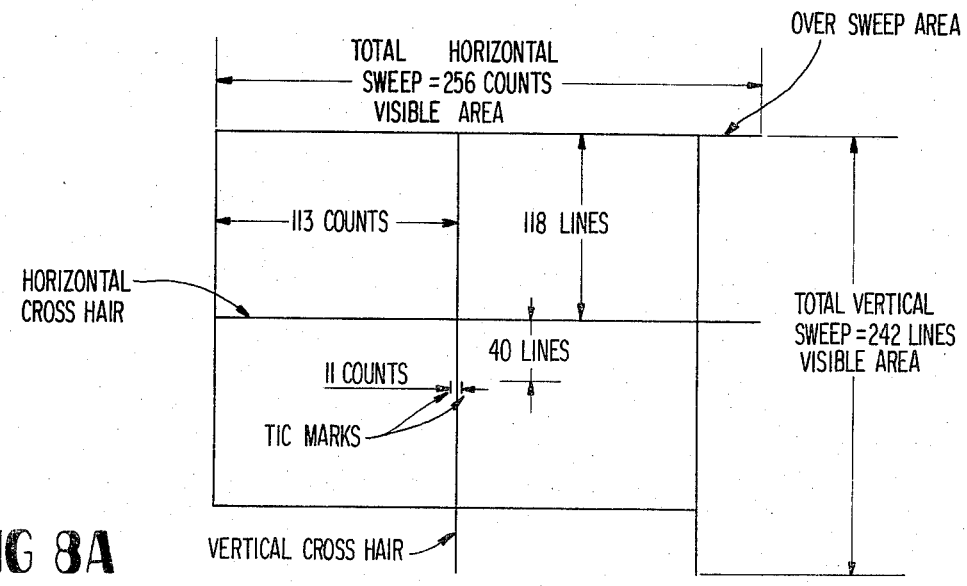
Figure 8:
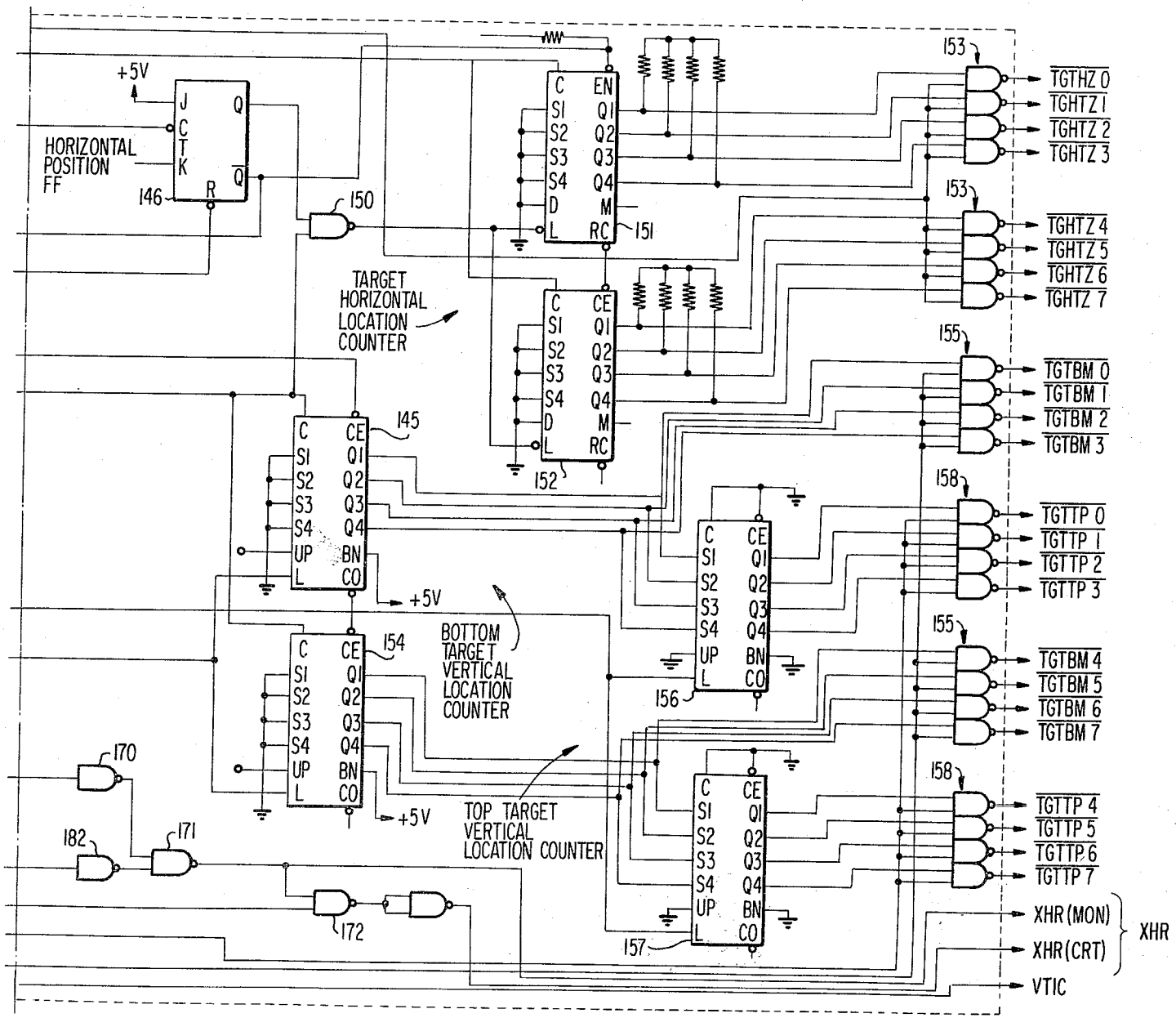
Figure 8I:
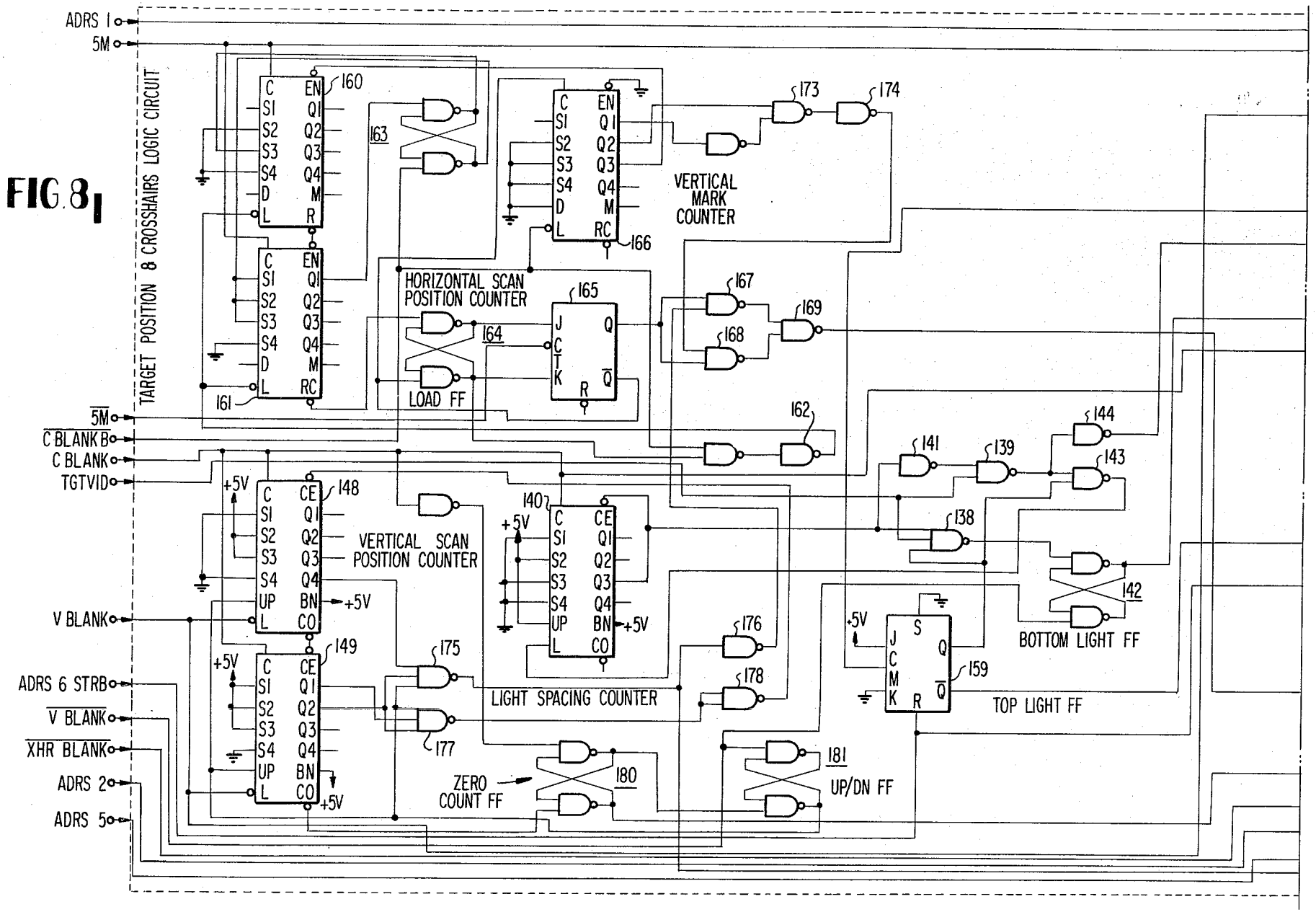

Referring now to FIG. 8 wherein one embodiment of the target position and cross hairs logic circuit 72 is illustrated in detail, the target video signal TGTVID from the camera video circuit 42 (FIG. 2) is supplied to one input terminal of a three input terminal NAND gate 138 and to one input terminal of a two input terminal NAND gate 139. An output signal from the binary four output terminal Q3 (i.e. the $2^2$ output terminal) of a conventional binary counter 140, the light spacing counter, is applied through an inverter 141 to the second input terminal of the NAND gate 130 and to a second input terminal of the NAND gate 138.

The output signal from the NAND gate 138 is applied to the set input terminal of a convention flip flop 142 formed by two NAND gates as illustrated. The output signal from the NAND gate 139 is applied to one input terminal of a two input terminal NAND gate 143 and through a non-inverting amplifier 144 to the reset input terminal R of a conventional J-K flip flop 146 (i.e. the horizontal position flip flop). The output signal from the bottom light flip flop 142 is applied to the count enable input terminal CE of a conventional presetable binary counter 145, and the output signal from the NAND gate 143 is applied to the load input terminal L of the counter 140.

The vertical blanking signal VBLANK generated by the status and panel interface 64 in response to the TV camera sync signals is supplied to the clock input terminal C of the horizontal position flip flop 146 and to the load input terminal L of a vertical position counter comprising two conventional four-stage presettable counter 148 and 149 connected serially. The output signal from the true output terminal Q of the horizontal position flip flop 146 is applied to one input terminal of a two input terminal NAND gate 150. The other input terminal of the NAND gate 150 receives the CBLANK signal from the TV Camera 26 of FIG. 2, and the output signal from the NAND gate 150 is applied to the load input terminal L of a target horizontal location counter is the 5 MHz (5M) clock signal from the clock signal generator 70. The count enable input signal for counter 151 is provided from the $\overline{Q}$ output terminal of the flip flop 146. The 8-bit output signal from the target horizontal location counter is gated by a group of eight NAND gates 153 in response to the ADRS1 signal from the address decoder 54 of FIG. 2. The NAND gates 153 provide, as output signals, the horizontal target position signals $\overline{TGTHZ0\text{-}7}$ for use by the microprocessor.

The CBLANK signal from the TV camera is supplied as the clock signal to the vertical position counter (counter 148 and 149) and to the light spacing counter 140. The CBLANK signal is also supplied as the clock signal to a bottom target vertical location counter comprising the counter 145 serially connected to another conventional binary counter 154. The 8-bit output signal from the bottom target vertical location counter is supplied to a group of NAND gates 155 and is gated by the ADRS 5 signal to provide the bottom target position signals $\overline{TGTBM1\text{-}7}$. The 8-bit output signal from the bottom target vertical location counter is alos supplied to the preset input terminals S1-S4 of two conventional binary counters 156 and 157 that together form a top target vertical location counter. The load signal for the top target vertical location counter is supplied from the Q output terminal of a J-K flip flop 159 (the top light flip flop) which is clocked by the signal from the Q output terminal the flip flop 146. The 8-bit output signal from the top target vertical location counter is gated through NAND gates 158 by the $\overline{ADRS\ 2}$ signal from the address decoder 54 to provide the top target position signals $\overline{TGTTP0\text{-}7}$ for use by the microprocessor.

Horizontal and vertical scan position counters are provided to generate the cross hairs signal and the vertical TIC signal used by the TV monitor 19 and, during alignment of calibration tests, by the CRT 30. The horizontal scan position counter comprises serially arranged binary counters 160 and 161. The 5 MHz (5M) clock signal provides the clock to the count or clock input terminals C of the counters 160 and 161 and the output signal from an inverter 162 provides the load signal to the terminals L of the counters.

The output signal from the Q1 output terminal of the counter 161 (the $2^4$ output signal from the position counter) is applied to the input terminal of the set side of a conventional flip flop or latch 163, and the output signal from a carry output terminal RC of the counter 161 is applied to the set side of a similar flip flop 164 (the load flip flop). The $\overline{CBLANKB}$ signal from the rectangle generator 60 of FIG. 2 is applied to the reset input side of the flip flop 163 and the output signals from the set and reset sides of the flip flop 163 are applied to the respective 53 and 41, 52, 53 input terminals of the counters 160 and 161.

The output signals from the set and reset sides of the flip flop 164 are applied to the respective J and K input terminals of a J-K flip flop 165 which is clocked by the inverted 5 MHz clock signal $\overline{5M}$ from the clock signal generator 70. The output signal from the $\overline{Q}$ output terminal of the flip flop 165 is applied to the reset input side of the flip flop 164 and to the clock input terminal of a conventional binary counter 166, the vertical mark counter. The output signal from the Q output terminal of the flip flop 165 is applied to one input terminal of each of the NAND gates 167 and 168, and the output signals from the gates 167 and 168 are gated together through a NAND gate 169. The output signal from the NAND gate 169 is applied through an inverter 170 to one input terminal of a NAND gate 171, the output signal of which is applied to one input terminal of a NAND gate 172 and as the XHR(MON) output signal.

The output signal from the Q1 output terminal of the vertical mark counter 166 is inverted and applied to one input terminal of a NAND gate 173. The Q2 output signal from the counter 166 is applied to the other input terminal of the NAND gate 173, and the output signal of the NAND gate 173 is applied through an inverter 174 to the second input terminal of the NAND gate 168.

The vertical position counter 148 supplies an output signal from the Q4 output terminal to one input terminal of a three terminal NAND gate 175, the output signal from which is provided as the VTIC signal and is inverted by an inverter 176 and applied to the other input terminal of the NAND gate 167. The vertical position counter also supplies an output signal from the Q1 output terminal of the counter 149 to one input terminal of a three input terminal NAND gate 177, the output signal of which is inverted by an inverter 178 and applied to the count enable input terminal CE of the counter 148. The Q2 output signal from the counter 149 is applied to a second input terminal of each of the NAND gates 175 and 177, and the carry output signal from the CO output terminal of the counter 149 is applied to the reset side of a flip flop 180 (the zero count flip flop). The CBLANK signal is inverted and applied to the set input side of the flip flop 180, and the output signals from the respective set and reset sides of the flip flop 180 are applied to the reset side of an up/down flip flop 181 and through an inverter 182 to the other input terminal of the NAND gate 171, respectively. The set side of the flip flop 181 receives the VBLANK signal as does the reset side of the flip flop 142.

The reset side of the flip flop 181 provides a signal to the UP input terminals of the counters 148 and 149 and to the third input terminals of each of the NAND gates 175 and 177.

The ADRS 6 STRB (address 6 strobe) signal from the address decoder 54 of FIG. 2 is applied as the reset signal to the flip flop 159 and as the load signal for the bottom target vertical location counter 145, 154. The cross hairs blanking signal $\overline{\text{XHR BLANK}}$ from the status output circuit 56 of FIG. 2 is applied to the second input terminal of the NAND gate 172 and the output signal from the NAND gate 172 is supplied through an inverter 183 as the XHR(CRT) signal for use by the CRT 30 for calibration.

In operation, the horizontal position flip flop 146 is set by the vertical blanking signal VBLANK and the target horizontal location counter 151, 153 is enabled. The target location counter is zeroed at the beginning of each horizontal scan line and then counts the pulses of the five megahertz clock signal 5M until the horizontal position flip flop 146 is reset by the detected target video signal TGTVID. Accordingly, the count in the target horizontal location counter when the target is detected will represent the location of the top target light (also presumed to be the horizontal position of the bottom target light relative to the beginning of the horizontal sweep, i.e. the edge of the TV image.

The bottom target vertical location counter 145, 154 is reset or loaded with a zero count in response to the address six strobe and is enabled to count the number of horizontal lines from the initiation of a new frame until the top target light is encountered. When the top target is encountered, the top light flip flop 159 is reset and the count in the bottom target vertical location counter 145, 154 is loaded into the top target vertical location counter 156, 157 which acts as a storage register. The light spacing counter 140 is simutaneously zeroed and enabled to count to a count of four. Each time a light (target) is detected subsequent to the first time, the light spacing counter 140 is reset if it has not counted at least three horizontal lines in the video with no detected light. On the fourth count without a detected light, the light spacing 140 sets the bottom light flip flop 142 and the next detected target light pulse in the target video signal locks the bottom target vertical location counter 145, 154 at its existing count at the time of detection.

Accordingly, it will be appreciated that the target horizontal location counter provides a count that is indicative of the horizontal position of the target relative to the edges of the TV picture. Similarly, the top target vertical location counter provides a count related to the number of horizontal lines down from the top of the TV picture at which a target is first detected. The bottom target vertical location counter provides a count indicative of the number of horizontal lines down from the top of the TV picture at which the second target is detected. The light spacing counter 140 ensures that the first detected light, if it is detected in more than one horizontal scan line, is not detected as the second light. This is accomplished by ensuring that the second light cannot be detected within three horizontal lines of detection of the first light. The data thus generated and stored in the target horizontal location counter, the bottom target vertical location counter and the top target vertical location counter may be selectively addressed by the microprocessor for transmission thereto through the multiplexer 68 of FIG. 4 as this data is required (e.g. for ranging, for determining the size of the kill zone, etc.).

The horizontal position counter 160, 161 is clocked in response to the five megahertz clocks signal and is arranged to generate the horizontal cross hair signal at a predetermined location relative to the edges of the TV picture. Similarly, the vertical position counter 148, 149 generates a data signal at an appropriate vertical position in the TV picture by counting the horizontal scan lines and providing an output signal to reset the zero count flip flop 180 after an appropriate number of horizontal scan lines have been counted. The signal relating to the horizontal position of the cross hairs is combined with the signal relating to the vertical position of the cross hairs by the NAND gate 171 to provide the cross hairs signal XHR(MON) to the target TV monitor 19 of FIG. 2. The cross hairs blanking signal gates the cross hairs signal through the gate 172 as the XHR(CRT) signal when the system is put into calibration mode so that the cross hairs signal may be fed to the cathode ray tube 30 of FIG. 2.

The vertical position counter also generates the vertical TIC signal utilized with the TV monitor 19 and the CRT 30 for calibration purposes. The vertical TIC signal is generated for a short period of time at two horizontally spaced positions by again counting the number of horizontal scan lines and generating the vertical TIC marks signals at the appropriate horizontal position in the TV picture.

FIG. 8A illustrates the cross hairs and TIC marks as they appear on the TV monitor 19 in order to facilitate an understanding of the operation of the circuit of FIG. 8. As can be seen from FIG. 8A, the total horizontal sweep of the TV picture may be 256 counts including an oversweep area. Each count represents 200 nanoseconds of the total horizontal sweep period and the 256 counts correspond to 256 pulses of the 5 megahertz signal. The horizontal position counter is arranged to generate the appropriate vertical cross hair signal each time it reaches a count of 113. The vertical position counter is arranged to generate the horizontal cross hair signal when it has reached a count of 118 horizontal lines (i.e. after it has counted the camera blanking signal 118 times). After a count of 40 more lines (a total of 158 lines), the vertical position counter generates the TIC mark signal to signal the vertical position of the TIC marks in the TV roster.

The vertical cross hair and the vertical TIC mark timing is generated by the horizontal scan position counter and the vertical mark counter. As can be seen in FIGS. 8 and 8A, counters 160 and 161 count down from at a 5 megahertz rate from a preset value of 113 starting at the beginning of each horizontal line in the TV picture. When zero is reached the first time, this signals the horizontal position of the first TIC mark. The counter 160 is then preset to a count of 5 and counts down again to zero. When zero is reached this time, this signals the horizontal position of the vertical cross hair. The counter 160 is again preset to a count of 5 and counted down again once more to zero. This signals the horizontal position the second TIC mark and ends the vertical cross hair generator outputs for this particular horizontal line.

The horizontal cross hair and TIC mark timing is provided by the vertical scan position counter 148, 149 and its associated decoding logic. The vertical scan position counter is preset to a value of 118 during the vertical retrace interval and is counted down once for each horizontal line until it reaches zero. This signals the position of the horizontal cross hair. At this time, the counter is switched to count up by the up/down flip flop 181 and when the counter reaches the up counts of 40–47, these counts are decoded by the NAND gate 175 to signal the vertical location (i.e. the location from the top of the picture) of the two TIC marks. Counting is ended and the outputs are stopped with an up count of 48 is reached. The horizontal and vertical signals are combined by the logic gates 171 and 172 as was previously described to produce the signals used by the TV monitor 19 and CRT 30.

Status Output Circuit

The status output circuit 56 of FIG. 4 accepts the 02 data word from the microprocessor and demultiplexes this data word for use by the circuits in the interface electronics unit and by the display and control panel. To facilitate an understanding of the invention, the status output circuit 56 is illustrated in greater detail in FIG. 9.

Figure 9:
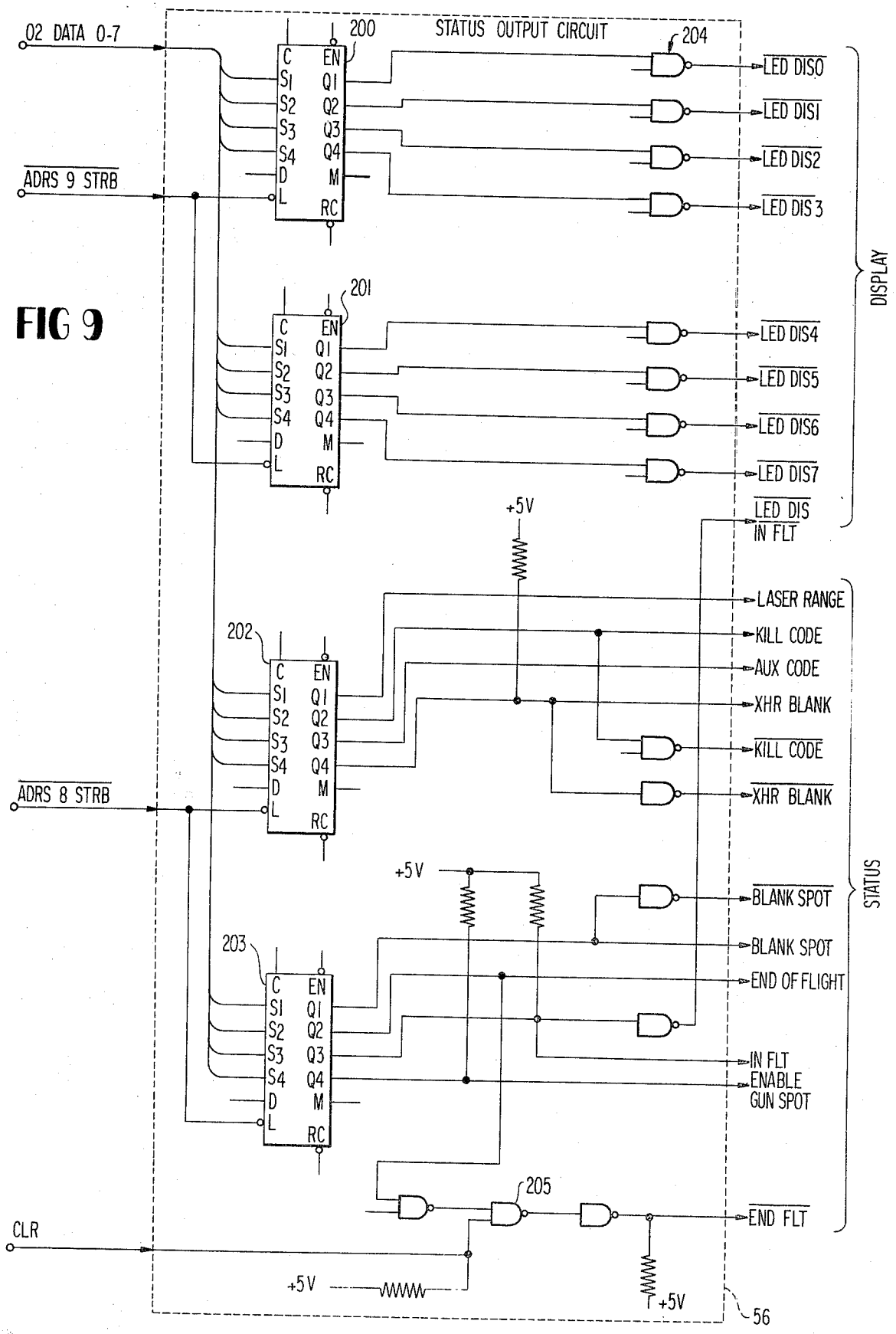

Referring now to FIG. 9, to 02 data word $\overline{02DAT0\text{-}7}$ from the microprocessor is supplied to four conventional registers 200–203 such as the illustrated presettable counters. The address nine strobe $\overline{ADRS9STRB}$ from the address decoder 54 of FIG. 4 is applied to the load input terminals of the registers 200 and 201 and the address eight strobe $\overline{ADRS8STRB}$ is applied to the load input terminals of the registers 202 and 203. The output signals from the registers 200 and 201 are supplied through NAND gates 204 connected as inverters to provide the $\overline{LED\ DIS0\text{-}7}$ display output signals.

The output signals from the register 202 are provided as the laser range, kill code, auxilary code and cross hairs blank STATUS signals. The output signals from the Q1-Q4 output terminals of the register 203 are supplied as the blank spot status signals, respectively. The end of flight signal ENDFLT is also inverted and gated by a two input terminal NAND gate 206 with the CLR signal from the panel to produce the end of flight signals $\overline{ENDFLT}$. In addition, the in flight signal INFLT is inverted and supplied as the $\overline{LED\ DISINFLT}$ display signal.

In operation, the status output circuit 56 accepts the 8-bit 02 data word from the microprocessor and this word is strobed into the registers 200 and 201 in response to the address nine strobe. The 02 data word, when strobed into the registers 200 and 201, makes up the LED display word that controls the display of data on the miss status indicators on the control panels. During actual simulator operation the missile hit/miss distance from the center of the kill zone is displayed in 0.1 meter increments. During diagnostic testing, the indicators on the display and control panels show systems status in response to the LED display word.

The LED display data is coded so that the least significant bit (bit-0) has a weight of 0.1 meter when it is being used to display hit/miss data. The display uses a straight binary code and therefore the distances of from 0.1 meter to 25.5 meters miss distance can be indicated.

When the 02 data is strobed into the registers 202 and 203 by the address eight strobe, this data is indicative of the indicated status data. Accordingly, the status output circuit, in essence, separates two different sets of data out of the 02 data word by strobing the data word into different sets of registers when the address strobes differ.

Circle Generator (Missile)

The circle generator generates a realistic simulated missile that moves under the control of the microprocessor and provides the capability of duplicating the dynamics of a real missile image. In order to accomplish this, the circle generator generates a missile image varying in size from 2 percent to 50 percent of the optical field of view and is capable of placing the simulated missile anywhere in the field of view. Moreover, the circle generator is able to move the missile image across the field of view either horizontally or vertically in four television frames or less (approximately 65 milliseconds).

Figure 10:
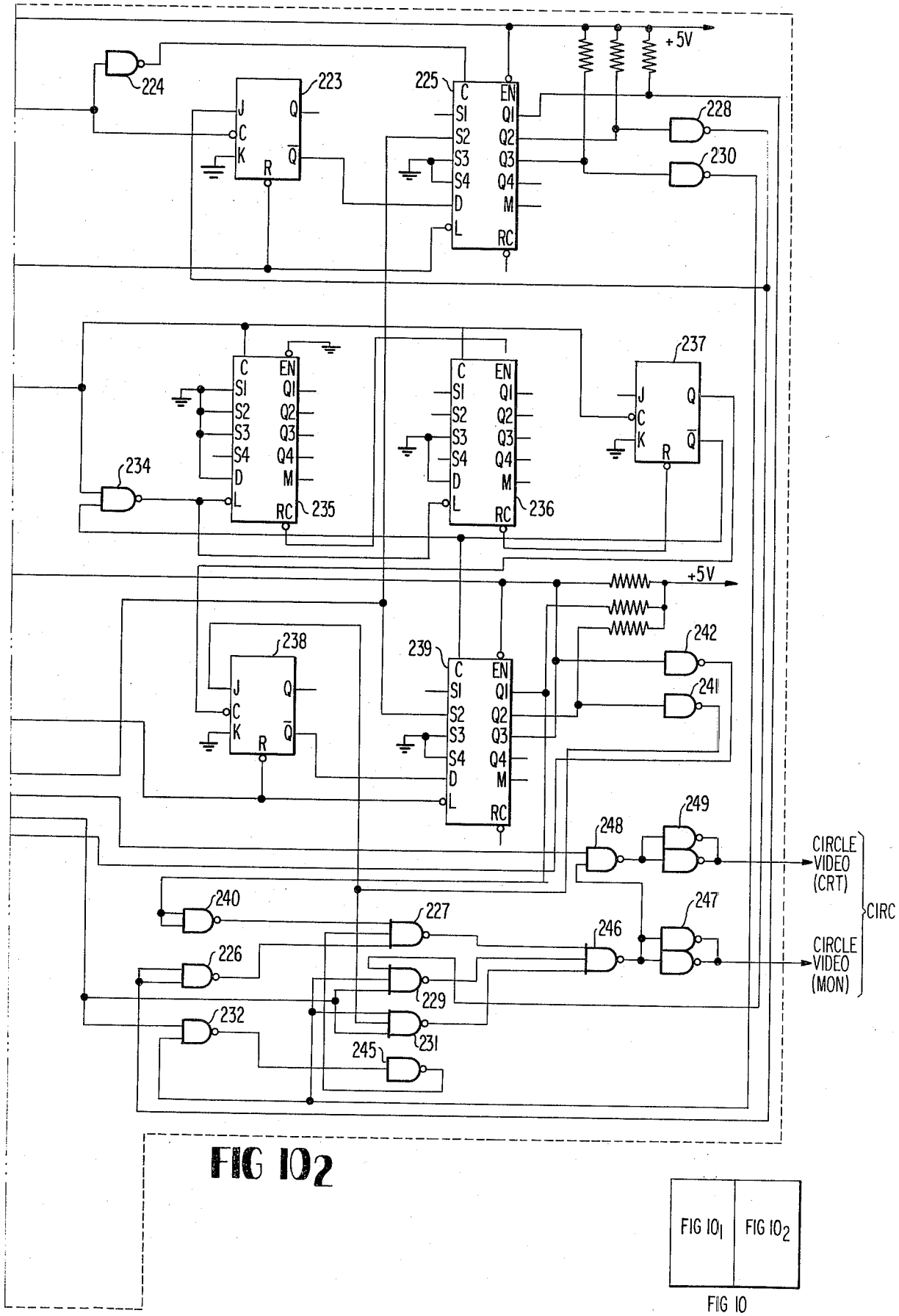
Figure 10:
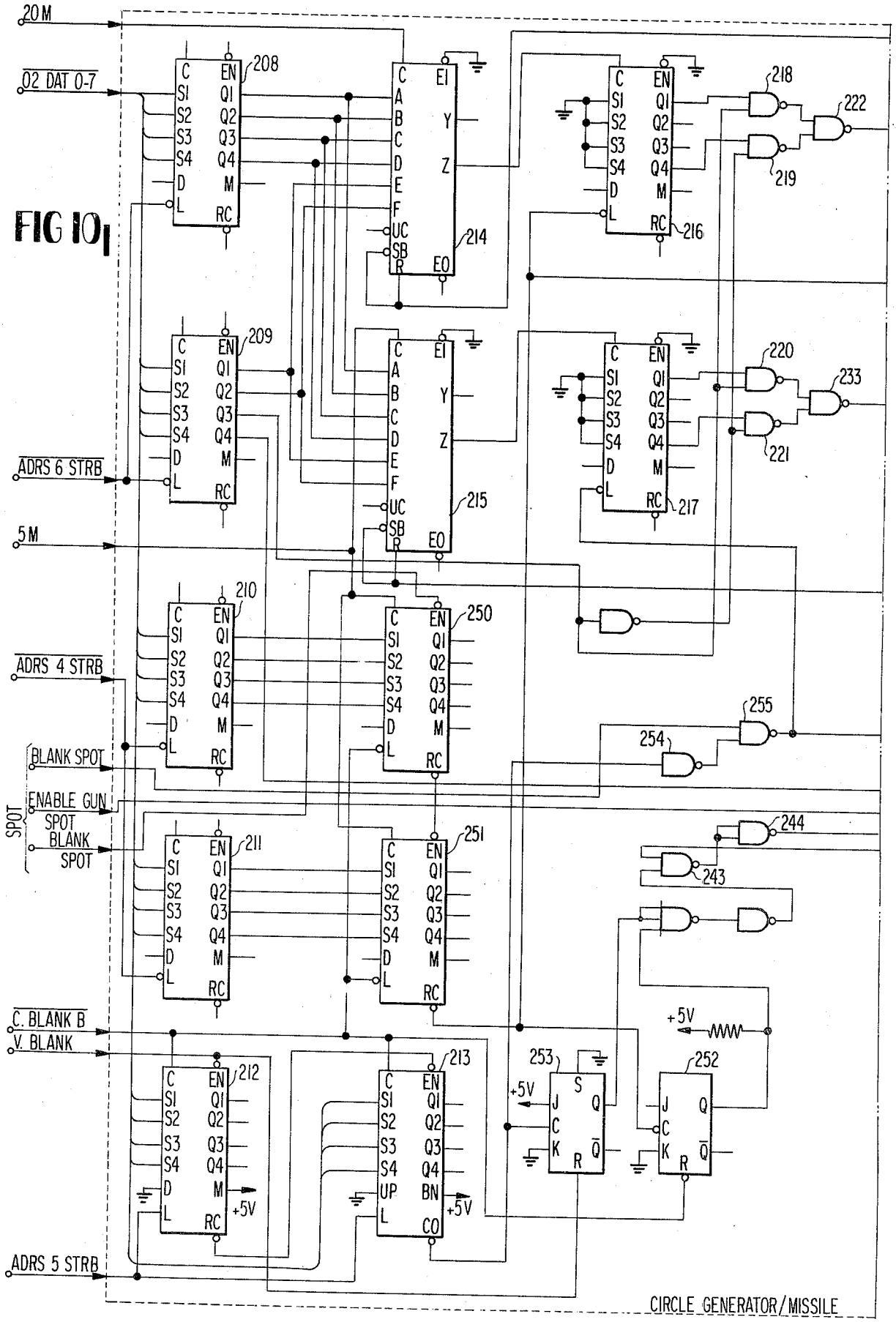

The details of the circuit which accomplishes the foregoing is illustrated in greater detail in FIG. 10. Referring now to FIG. 10, the 02 data word from the microprocessor is supplied to the data input or preset terminals S of 3, 8-bit registers made up of pairs of convention 4-bit registers or presettable counter 208–209, 210–211, 212–213. The ADRS6 $\overline{STRB}$ signal is applied to the load input terminals of the registers 208–209, the $\overline{ADRS4\ STRB}$ signal is applied to the load input terminals of the registers 210–211, and the ADRS5 STRB signal is applied to the load input terminals of the register 212–213.

The output signals from the Q1-Q4 and Q1-Q2 output terminals of the registers 208 and 209, respectively, are applied to the respective terminals A–F of each of two rate multipliers 214 and 215 as illustrated. The rate multipliers 214 and 215 are conventional circuits having a transfer function of frequency out Fo equal to N/64 times the frequency in Fi(Fo=(Fi) (N/64)) where N is the binary value of the 6 least significant bits of the data word). The output signals from the rate multipliers are scaled by dividing by two or by sixteen as selected by the 6th bit of the data signal applied thereto (the bit applied to the F-input terminal).

The Z output terminal of each of the rate multipliers 214 and 215 are each connected to the clock input terminals C of respective down counters 216 and 217. The output signals from the Q1 and Q4 output terminals of the counter 216 are applied to the input terminals of respective NAND gates 218 and 219. and the output signals from the Q1 and Q4 output terminals of the counter 217 are applied to the respective input terminals of NAND gates 220 and 221. The output signal from the Q3 output terminal of each of the NAND gates 219 and 221 and is applied in its uninverted form to an input terminal of each of the NAND gates 218 and 220.

The output signals from the NAND gate 218 and 219 are gated together through a NAND gate 222, and the output signals from the NAND gate 222 is applied directly to the clock input terminal of a J–K flip flop 223, and through inverter 224 to the clock input terminal of a conventional down counter 225. The output signal from the $\overline{Q}$ output terminal of the flip flop 223 is applied to the down control terminal D of the counter 225, and the signal from the Q4 output terminal of the counter or register 209 is supplied to the S2 data input terminal of the counter 225.

The output signals from the Q1 output terminal of the counter 225 is applied through an inverter 226 to one input terminal of a 3 input terminal NAND gate 227. The output signal from the Q2 output terminal of the counter 225 is applied through an inverter 228 to the J input terminal of the flip flop 223 and to one input terminal of a 3 input terminal NAND gate 229. The output signal from the Q3 output terminal of the counter 225 is applied through an inverter 230 to an input terminal of the NAND gate 229 and to one input terminal of each of the 3 input terminal NAND gates 231 and 232. The output signal from the counter 225 is also applied to the enable input terminal EN of the counter 225 and to both the reset terminal R and the SB terminal of the rate multiplier 214.

The NAND gates 220 and 221 provide output signals that are gated together through a NAND gate 233 and applied to one input terminal of a two input terminal NAND gate 234, to the clock input terminal C of a conventional down counter 235, to the clock input terminal C of a conventional down counter 236 and to the clock input terminal of a J–K flip flop 237. The output signal of the NAND gate 234 is applied to the load input terminals L of each of the counters 235 and 236. The carry output signal from the RC terminal of the counter 235 is applied to the enable input terminal of the counter 236, and the carry output signal from the counter 236 is applied to the reset terminal of the flip flop 236.

The output signal from the Q output terminal of the flip flop 236 is applied to the clock input terminal of a flip flop 238 and the output signal from the $\overline{Q}$ output terminal of the flip flop 237 is applied both to the clock input terminal C of a conventional down counter 239 and to the second input terminal of the NAND gate 234. The output signal from the Q output terminal of the flip flop 238 is applied to the down control terminal D of the counter 239, and the counter 239 receives a signal on the S2 input terminal from the Q4 output terminal of the register 209. The output signal from the Q1 output terminal of the counter 239 is applied through an inverter 240 to one input terminal of the NAND gate 227, and the output signal from the Q2 output terminal of the counter 239 is applied through an inverter 241 to the J input terminal of the flip flop 238 and to an input terminal of the NAND gate 231.

The output signal from the Q3 output terminal of the counter 239 is applied to the enable input terminal EN of the counter 239, to the R and SB terminals of the rate multiplier 215, and through an inverter 242 to one input terminal to a two input terminal NAND gate 243.

The output signal from the NAND gate 243 is applied through an inverter 244 to a second input terminal of the NAND gate 232 and to an input terminal of both the NAND gate 229 and the NAND gate 231. The output signal from the NAND gate 232 is supplied through an inverter to 245 to the third input terminal of the NAND gate 227, and the signals from the NAND gates 227, 229 and 231 are gated together by a NAND gate 246. The output signal from the NAND gate 246 is supplied through an inverting circuit 246 as the circle video CIRC (MON) and to one input terminal of a two output terminal NAND gate 248. The enable gun spot signal from the status output circuit of FIG. 4 is applied to the second input terminal of the NAND gate 248 and the output signal from the NAND gate 248 is inverted by an inverting circuit 249 and supplied as the circle video CIRC (CRT) signal.

The five megahertz clock signal 5M is supplied to the clock input terminal of the rate multiplier 25 and to the clock input terminals of a pair of conventional serially connected down counters 250 and 251. The signals from the Q1 to Q4 output terminals of the register 210 are supplied to the respective S1–S2 input terminals of the counter 250, and the signals from the Q1–Q4 output terminals of the register 211 are supplied to the respective S1–S4 input terminals of the counter 251. The $\overline{CBLANKB}$ signal is supplied to the load input terminals of the counters 250 and 251 as well as the clock input terminals of the registers 212 and 213 and to the reset input terminal of a J–K flip flop 252.

The output signal from the carry output terminal RC of the counter 251 is supplied to the load input terminal L of counters 216 and 225, to the reset input terminal R of the flip flop 223 and to the clock input terminal of the flip flop 252. The VBLANK signal is supplied to the enable input terminal CE of the register 212 and to the reset input terminal of a J–K flip flop 253. The output signal from the carry output terminal CO of the register 213 is supplied to the clock input terminal of the flip flop 253 and through an inverter 254 to one input terminal of a two input terminal NAND gate 255. The blank spot signal from the status output circuit is supplied to the second input terminal of the NAND gate 255, and the output signal from the NAND gate 255 is supplied to the load input terminal of a counter 217, to the reset terminal of a flip flop 238 and to the load input terminal of a counter 239.

In operation, the 8-bits of the 02 data word $\overline{02DAT0-7}$ are stobed into one set of the registers 208–213 depending upon the presence of the appropriate address strobe (i.e., depending upon the nature of the data). Missile diameter control data is strobed into the registers 208–209 by the address 6 strobe signal. Missile horizontal position data is strobed into the registers 210–211 by the address 4 strobe, and missile vertical position data is strobed into the registers 212–213 by the address 5 strobe signal. This data is updated by the microprocessor every TV frame during the vertical retrace interval of the TV camera.

The diameter of the electronically simulated missile is controlled by use of the two rate multipliers 214 and 215 which receive the current missile diameter control information from the registers 208–209. These rate multipliers receive the diameter control data and use the binary value of the first 6 bits to establish a frequency transfer factor N (where N is the binary value of the first 6 bits), resulting in an input frequency Fi to output frequency Fo transfer functions of Fo=Fi(N/64). The 6th bit also establishes a scale factor S of either 2 or 16 by which the input frequency is divided.

The output signals from the rate multipliers 214 and 215 ultimately control the clocking of respective counters 225 and 235–236. The counter 225 is controlled to count from 3 to 0 then back up to 3 for a total of seven steps. The time during which the counter 225 is counting represent the horizontal diameter of the missile video (circle) displayed on the TV monitor and CRT. Since the output frequency Fo of the rate multipliers is scaled by a factor S equal to 2 to 16, the horizontal size H of the circle may be expressed by the following equation:

$$H=(S/Fo)\ (7)$$

Since the data to the rate multipliers is inverted, the output frequency of each rate multiplier can be expressed as:

$$Fo=(Fi)\ (63-N)/64$$

Since Fi is equal to 20 MHz, the final formula for horizontal size H is as follows:

$$H=(S)\ (2.24)\ (10^5)\ (7)/(63-N)$$

The vertical size of the circle video, if the circle is to be round, must be coordinated with the horizontal size taking into account the differences in horizontal and vertical sweeps of the display. The rate multiplier 215, which provides the same output frequency as the multiplier 214 and is redundant in this respect, operates in conjunction with the counters 235, 236 and 239, and flip flops 237 and 238, to provide the correct relationship between horizontal and vertical size.

Specifically, the vertical size of the circle follows the following scaling ratio to ensure a circular simulated missile:

Horizontal frequency (Fh)/Vertical frequency (Fv)×aspect ratio=350 where the horizontal frequency is 15,750 Hz, the vertical frequency is 60 Hz and the aspect ratio is 1.25 for a standard TV roster.

The counters 235 and 236 provide a scaling function and the vertical size counter 230 counts from 3 to 9 and back to 3 for a total of seven steps as does the horizontal size counter 225. The outputs signals from the respective horizontal and vertical counters 225 and 235 are decode by the gates 227, 229, 231 and 246 to produce the circle video. These gates are wired to produce a read-only-memory (ROM) function with the counters 225 and 239 acting as a six bit address generator to address the ROM. The gates thereby produce an output signal which is coordinated with a standard TV roster and which, when displayed on a standard TV screen, produces a filled in circle.

Flip flops 252 and 253 are clocked by the TV blanking signals to produce gating signals that prevent the circle from wrapping around when large circles are presented on the right side of the TV picture. Horizontal circle positioning is accomplished by the registers 210 and 211 is conjunction with counters 250 and 251. Vertical positioning of the circle is provided by the registers 212 and 213.

In this connection, the registers 210 and 211 receive circle horizontal position data from the microprocessor during each vertical retrace blanking interval. This data is transferred into the counters 250 and 251 at the start of each horizontal scan line and the counters are counted down to zero from these preset numbers in 200 nanosecond increments (5 Megahertz) during each horizontal scan line in order to provide a signal indicating the horizontal starting position of the circle video (i.e. the left edge of the simulated missile), and starting the horizontal size counter 225.

The vertical position registers 212 and 213 receive circle vertical position data from the microprocessor during the vertical retrace intervals. The vertical starting position of the circle is determined by counting down one count for each horizontal line from the number represented by this position data and starting the vertical size counter 239 when zero is reached. Since the counting to zero is at the horizontal line frequency and the counter must be reset with new data only once in each frame, the registers 212 and 213 can double as counters as illustrated. This is, of course, not possible with the horizontal position registers with the preferred arrangement because the horizontal position counters are counted to zero and preset each horizontal scan line.

Rectangle Generator (Kill Zone)

The rectangle or kill zone generator 60 accepts data from the microprocessor and generates signals that form a rectangular image on the TV monitor. The microprocessor data is conveniently generated in response to the target location (the positions of the top and bottom IR lights) and the size of the rectangle or kill zone desired. In the preferred embodiment, the top and bottom horizontal edges of the rectangle pass through the respective top and bottom target lights. The width of the rectangle is three times its height and is centered about the horizontal position of the target lights.

Rectangle Generator (Target Kill Zone)

The rectangle generator 60 of FIG. 4 receives data from the microprocessor and generates a video signal that forms a rectangle on the TV monitor. In the preferred embodiment, this rectangle is three times wider than it is high and has an uppermost edge that passes through the top infrared target light and a lowermost edge that passes through the bottom infrared target light as these target lights appear in the target video signal.

The area inside the rectangle formed by the rectangle generator 60 is the target kill zone. If the simulated missile (circle video) appears in this area when it flies through the plane of the target (i.e., has flown long enough to reach the target), a hit is scored. Thus, the aiming accuracy of the trainee can be judged by the system and those monitoring the trainee.

Figure 11:
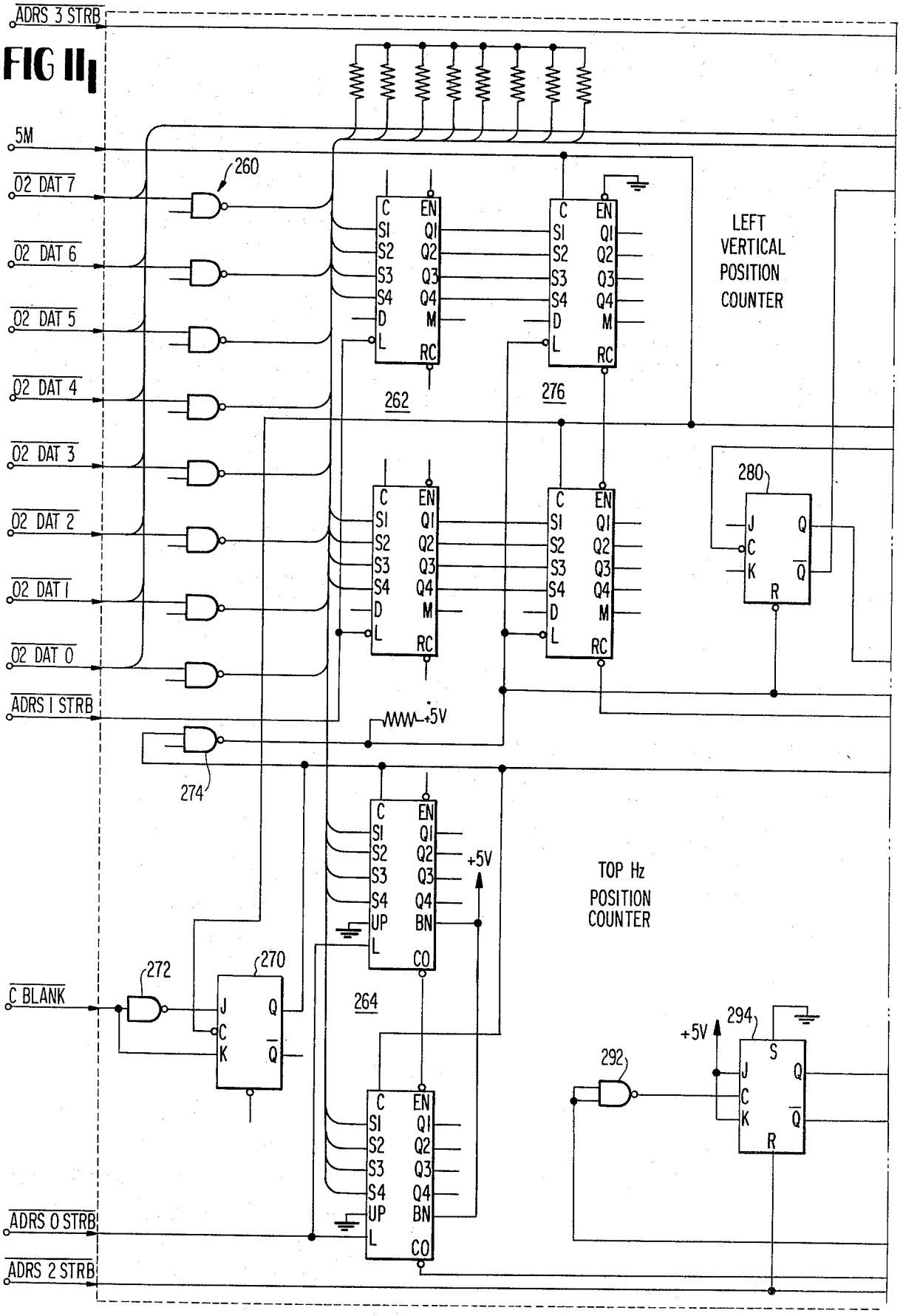

The rectangle generator 60 is illustrated in greater detail in FIG. 11 to facilitate an understanding of the invention. Referring to FIG. 11, the inverted 02 data word $\overline{02DAT0}$–$\overline{02DAT7}$ from the microprocessor is inverted by inverters 260 and is loaded into an eight-bit register 262 by the $\overline{ADRS1STRB}$ signal. The inverted 02 data word is also supplied to eight bit registers 264,266 and 268 where it is loaded by the respective $\overline{ADRS\ 0\ STRB}$, $\overline{ADRS\ 2\ STRB}$ and $\overline{ADRS\ 3\ STRB}$ signals from the address decoder. As will be appreciated, the registers 264 and 266 are arranged as down counters to locate the top and bottom horizontal lines in the rectangle video. The registers 262 and 268 are arranged as down counter circuits to locate the positions of the left and right sides of the rectangle video.

The $\overline{CBLANK}$ sync signal from the TV camera 26 of FIG. 2 is applied to the K input terminal of a J–K flip flop 270 and through an inverter 272 to the J input terminal of the flip flop 270. The flip flop 270 is clocked by the 5 Megahertz clock signal 5M and the output signal from the true output terminal Q of the flip flop 270 is applied to the clock input terminals of the registers 264 and 266, to an output terminal of the rectangle generator is the CBLANK signal, and through an inverter 274 to the load input terminals of conventional eight stage down counters 276 and 278. The signal from the inverter 274 is also applied to the reset input terminal R of a J–K flip flop 280 and is supplied as the $\overline{CBLANKB}$ output signal from the rectangle generator.

The data word stored in the register 262 is supplied to the data input terminals of the down counter 276, and the data word stored in the register 268 is supplied to the data input terminals of the down counter 278. The $\overline{RVERT}$ signal from the carry output terminal of the down counter 276 is applied to one input terminal of a two input terminal NAND gate 282, and the carry output signal from the counter 278 is applied to the other input terminal of the NAND gate 282. The output signal from the NAND gate 282 is applied to the clock input terminal of the flip flop 280 and to one input terminal of a NAND gate 284. The output signal from the NAND gate 284 is supplied to one input terminal of a NAND gate 286, the output signal from which is the rectangle video signal RECTVID.

The carry output signal $\overline{THORIZ}$ from the up counter 264 is applied to one input terminal of a NAND gate 288, the other input terminal of which is supplied with the $\overline{BHORIZ}$ signal from the carry output terminal of the counter 266. The output signal from the NAND gate 288 is supplied to a NAND gate 290 and through an inverter 292 to the clock input terminal of a J–K flip flop 294. The output signal from the NAND gate 290 is supplied through an inverter 296 to the other input terminal of the NAND gate 286 and to one input terminal of the NAND gate 298 which receives its other input signal from the NAND gate 284. The output signal from the NAND gate 298 is inverted by inverter 300 and supplied as the $\overline{RECTVIL}$ signal.

The J–K flip flop 294 receives the $\overline{ADRS\ 2\ STRB}$ signal on its reset input terminal R and supplies an output signal from its true or Q output terminal to the other input terminal of the NAND gate 284. The $\overline{Q}$ output signal from flip flop 294 is applied to the count or clock enable input terminal CE of the counter. Similarly, the flip flop 280 supplies the signal from its true or Q output terminal to the other input terminal of the NAND gate 290, and supplies the signal from the $\overline{Q}$ terminal to the count enable input terminal EN of the down counter 278. The counters 276 and 278 are clocked (counted down) by the 5M signal.

In operation, the 02 data words containing top and bottom horizontal position data are loaded into the counters 264 and 266 by the respective $\overline{ADRS\ 0\ STRB}$ and $\overline{ADRS\ 2\ STRB}$ signals. The 02 data word containing the left and right vertical position data are loaded into the registers 262 and 268 by the respective $\overline{ADRS\ 1\text{-}STRB}$ and $\overline{ADRS\ 3\ STRB}$ signals, and are then transferred into the respective counters 276 and 278 during each horizontal line retrace interval by the $\overline{CBLANK}$ signal. The data thus entered represents the exact locations of each of the four sides of the rectangle with respect to the top sides of the TV frame.

The counters 264 and 266 are counted down from the values preset by the 02 data words in response to the horizontal blanking signal (i.e. counts horizontal scan lines). When the counter 264 produces a carry output signal, the top edge of the rectangle has been reached in the video scan pattern and the $\overline{THORIZ}$ signal is produced. Similarly, the bottom edge of the rectangle has been reached and the $\overline{BHORIZ}$ signal is produced when the counter 266 produces a carry output signal.

The counters 276 and 278 count down in 200 nanosecond intervals from the values preset therein. During each horizontal scan line, the counters 276 and 278 produce a signal that represents the positions of the left and right vertical edges of the rectangle. At the end of each horizontal scan line, the counters are preset with the data then in the respective registers 262 and 268 so that the entire left and right vertical edges of the rectangle are produced.

New data is entered into the counters and registers during each vertical retrace interval. Thus, if the rectangle size changes, or its position relative to the edges of the TV frame changes, the changes are immediately made in the rectangle video on the next successive TV frame.

Audio System Control

The audio system control 62 of the embodiment of FIG. 4 controls the generation of the audio signal that simulates guidance thruster sounds (POPS) as well as the signal that causes simulation of launch (IGNITION). Also, the aiming error sounds (TONE FREQ) are controlled by the audio system control, and the analog range meter signal (RANGE METER) is generated by the audio system control. It should be noted here that the launch and hit sounds (both the same) are triggered by bit six of the discrete data word assuming a high signal level as previously mentioned.

Figure 12:
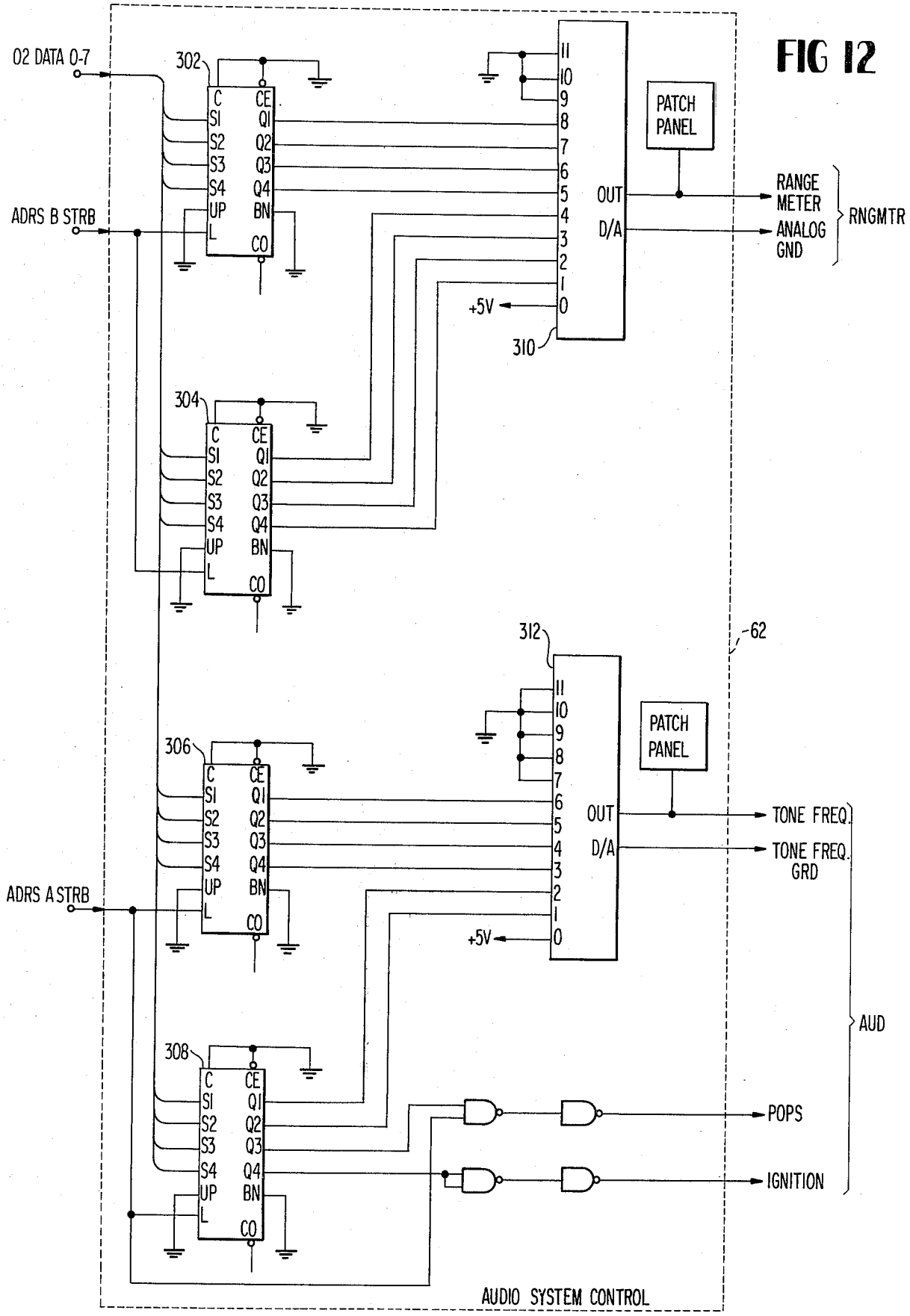

Referring now to FIG. 12 wherein the audio system control 62 is shown in greater detail, the first four bits of the 02 data word 02DAT0–02DAT3 are strobed into a four bit register 302 by the ADRS B STRB strobe signal. The next four bits 02DAT4–02DAT7 are strobed into a four bit register 304 by this same strobe signal. Similarly, the first and second four bit segments of the 02 data word are strobed into respective four bit registers 306 and 308 by the ADRS A STRB signal from the address decoder.

The eight bits of the 02 data word in the registers 302 and 304 represent target range and are supplied to eight digital input terminals of a conventional digital to analog (D/A) converter 310. The analog output signal from the D/A converter 310 is then supplied to an analog meter on the display and control panel to conventionally display range.

The six least significant bits of the 02 data word strobed into the registers 306 and 308 contain data related to the amount of aiming error that exists because of the trainee being off target. A digital to analog (D/A) converter 312 receives these six least significant bits and converts then to an analog signal that varies in value with aiming error. This analog signal (TONE FREQ) is used in a conventional manner to control the output frequency of a voltage controlled oscillator that the trainee may be made aware of aiming errors as a function of the frequency of an audible signal (e.g. low frequency, low aiming error). The lack of an audible signal may indicate that the aiming point (and thus the missile) is within the kill zone.

Bit six of the 02 data word in the register 308 is used to generate the thruster sound. When this bit assumes a high signal level, the POP signal is generated, triggering or gating on a suitable oscillator or noise generator that simulates the firing of a missile thruster.

Bit seven of the 02 data word in the register 308 is not used to produce a sound in the illustrated embodiment, but rather produces the signal (IGNITION) that simulates launch of a missile. When bit seven assumes a high signal level, a spring loaded weight in the simulator launch tube is released to simulate the weight shift of a real missile being launched.

Word 2 Multiplexer

The word 2 multiplexer 68 of FIG. 4 accepts data addressed by the address decoder 54 and establishes input data channels to the microprocessor as a function of this addressed data. Since the address decoder 54 addresses data in the various interface electronic circuit in response to data received from the microprocessor, the microprocessor itself selects the subsystem from which it desires to read data and supplies this addressed data to the multiplexer.

Figure 13:
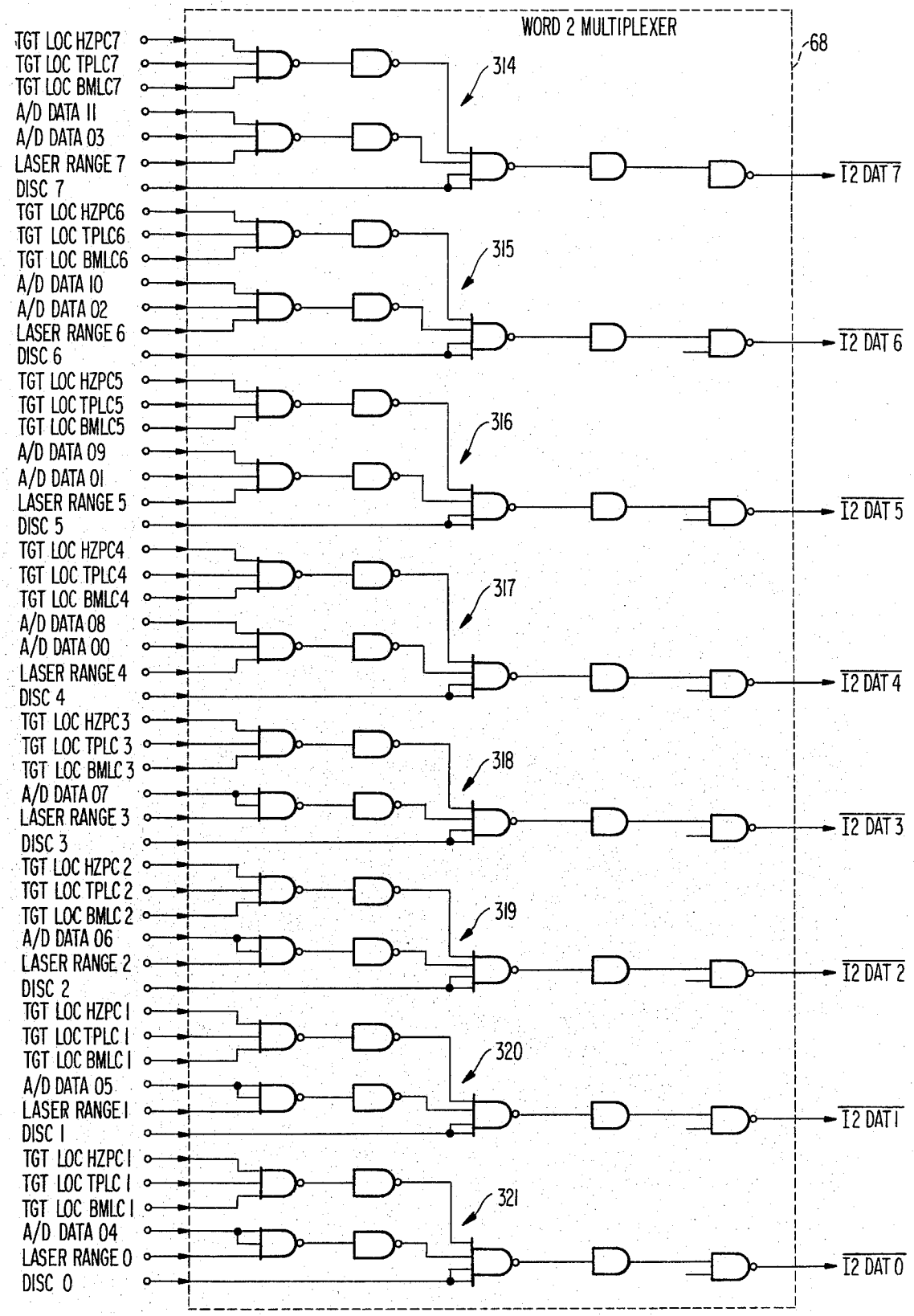

As can be seen in FIG. 13 wherein the word 2 multiplexer is shown in greater detail, addressed data is supplied to a series of gating circuits generally indicated at 314–321. These gating circuits form seven channels for generation of the respective 0–7 bits of the microprocessor I2 input data word $\overline{\text{I2DAT0}}$–$\overline{\text{I2DAT7}}$. When a particular data source in the interface electronics unit is selected by its address word, the individual bits of its data word are supplied to the respective gating circuits 314–321. This data is passed by the gating circuits (which function to OR the data lines for each data channel) as the I2 data word to the microprocessor.

The microprocessor can thus command the transfer of target location data or the like by the generation of the appropriate address. This data is then transferred to the microprocessor through the word 2 multiplexer 68 when the microprocessor requires this data to calculate rectangle size and location, etc.

Status and Panel Interface

The status and panel interface 64 generates the I3 data word that provides data and control inputs that set up the initial condition of the simulator problem in the microprocessor. Also, the interface 64 generates the discrete data word (DISC0–DISC7 in FIG. 4) that allows the microprocessor to read eight independent discrete data points during normal operation.

Figure 14:
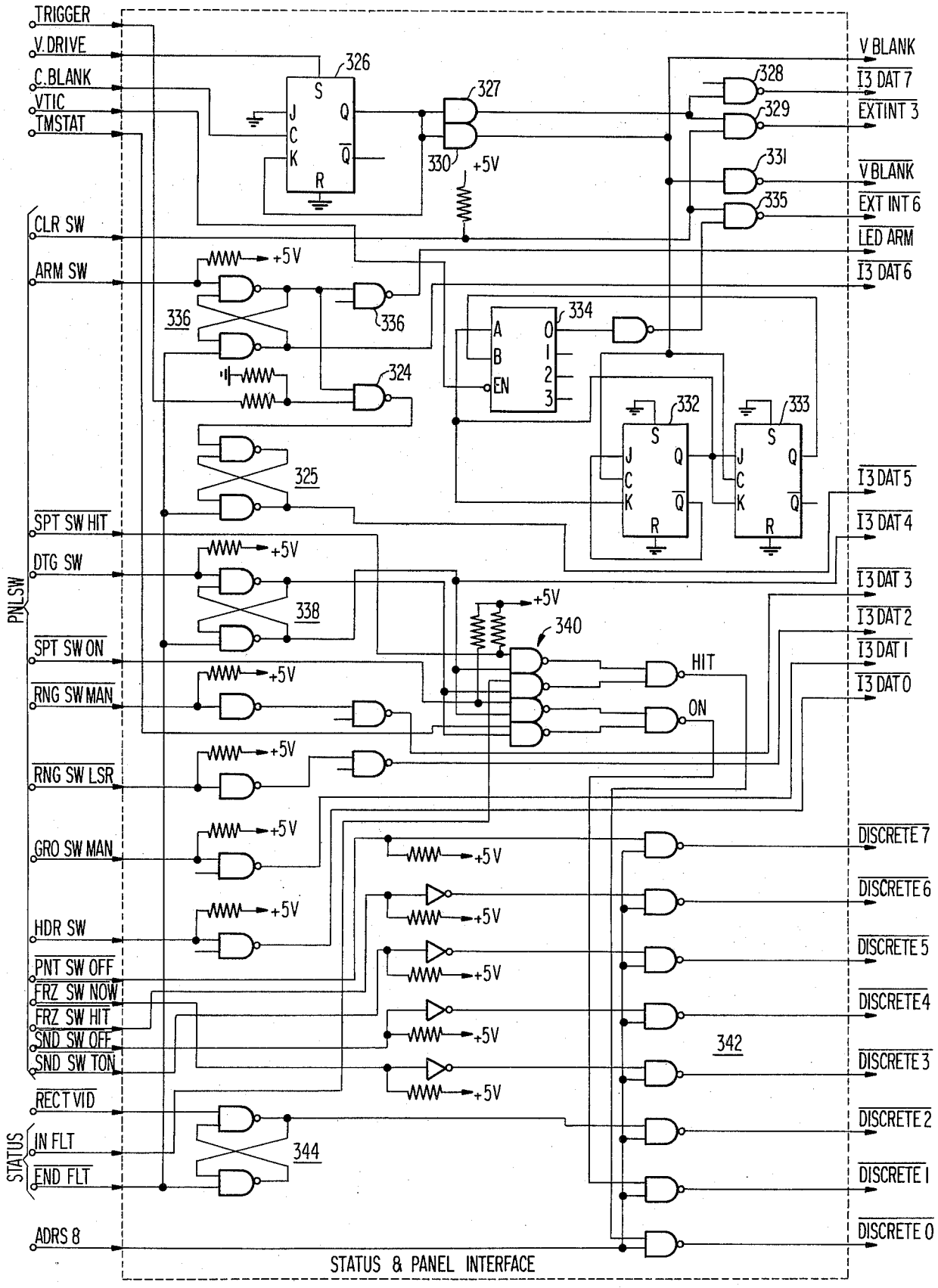

Referring to FIG. 14 wherein the status and panel interface 64 of FIG. 4 is illustrated in greater detail, the TRIGGER signal from the launch switch of FIG. 2 is applied to a NAND gate 324, the output signal from which is applied to the set of a flip flop or latch circuit 325. The vertical drive and camera blanking signals VDRIVE and CBLANK from the TV camera 26 are supplied to the respective set and clock input terminals S and C of a J–K flip flop 326. The output signal from the Q output terminal of the flip flop 326 is applied to the K input terminal thereof and through an inverter 326 both to an inverter 328 that provides the $\overline{\text{I3DAT7}}$ signal and to a NAND gate 329. The signal from the Q output terminal of the flip flop 326 is also supplied through inverters 330 and 331 as the $\overline{\text{VBLANK}}$ signal, through inverter 330 as the VBLANK signal and to the clock input terminals C of a pair of J–K flip flop 332 and 333 connected as a two stage binary counter.

The VTIC signal from the target position and cross hairs logic circuit 72 of FIG. 4 is applied to the enable input terminal EN of a conventional two line to four line decoder 334, and the output signal from the decoder 334 is inverted and applied to one input terminal of a NAND gate 335. The clear switch (CLR SW) on the control panel 18 is connected to the second input terminal of the NAND gate 329 and to the second input terminal of the NAND gate 335. The NAND gates 329 and 335 supply the respective $\overline{\text{EXTINT 3}}$ and $\overline{\text{EXTINT 6}}$ signals that are provided to the microprocessor as interrupts for use as the primary microprocessor timing.

The arm switch (ARM SW) in the control panel 18 is connected to the set side of a conventional latch or flip flop 336. The set output side of the flip flop 336 is connected through an inverter 337 to provide the $\overline{\text{LEDARM}}$ display signal and is connected to the second input terminal of the NAND gate 324. The reset output side of the flip flop 336 provides the $\overline{\text{I3DAT6}}$ signal. The reset output side of the flip flop 325 provides the $\overline{\text{I3DAT5}}$ signal.

The diagnostic trigger switch (DGTSW) is connected to the set input side of a flip flop or latch 338. The set and reset output sides of the flip flop 338 are connected to a gating circuit 340 as illustrated, and the reset output side also supplies the $\overline{\text{I3DAT4}}$ signal. The signals from the manual range switch $\overline{\text{RNG SWMAN}}$ and from the laser range switch $\overline{\text{RNG SWLSR}}$ are twice inverted to provide the $\overline{\text{I3DAT3}}$ and $\overline{\text{I3DAT2}}$ signals, respectively. The signals from the manual gyro switch GROSWMAN and from the header switch HDRSW are inverted to provide the respective $\overline{\text{I3DAT1}}$ and $\overline{\text{I3DAT0}}$ signals.

The spot switch on and spot switch hit signals $\overline{\text{SPTSWON}}$, $\overline{\text{SPTSWHIT}}$ from the control panel 18 are supplied together with the in flight status signal INFLT to the gating circuit 340. The HIT and ON signals from the gating circuit 340 are supplied to the respective first and second gates in a series of eight NAND gates 342 to provide the $\overline{\text{DISCRETE 0}}$ and $\overline{\text{DISCRETE 1}}$ output signals. The end flight status signal $\overline{\text{ENDFLT}}$ is supplied to the reset side of a flip flop or latch 344, and the rectangle video signal $\overline{\text{RECTVID}}$ is supplied to the set side of the latch. The output signal from the set side of the latch 344 is supplied to the third of the gates 342 to produce the $\overline{\text{DISCRETE 2}}$ signal when gated through.

The current frame freeze switch on the panel 18 supplies the $\overline{\text{FRZSWNOW}}$ signal to the fourth gate of the gating circuit 342 to produce the $\overline{\text{DISCRETE 3}}$ signal. Similarly, the sound off switch signal $\overline{\text{SNDSWOFF}}$, the sound tone on switch signal $\overline{\text{SNDSWTON}}$, the hit frame freeze switch signal $\overline{\text{FRZSWHIT}}$ and the print switch off signal $\overline{\text{PNTSWOFF}}$ from the control panel 18 are supplied to the gating circuit 342 to produce the respective $\overline{\text{DISCRETE 4}}$–$\overline{\text{DISCRETE 7}}$ output signals. The eight bits of the $\overline{\text{DISCRETE}}$ output signal are gated through the circuit 342 by the address 8 signal ADRS 8 for transmission to the microprocessor via the word 2 multiplexer 68 as was previously described.

It will be appreciated that the status and panel interface circuit provides the microprocessor with the ability to read 16 discrete data points for status and control purposes. Moreover, two system interrupts are generated for timing control purposes.

The $\overline{\text{EXTINT 3}}$ interrupt is generated at a 60 PPS rate to syncronize the microprocessor with the TV frame rate in the system. This interrupt occurs in place with the camera vertical blanking signal CLBLANK and identifies the time when the microprocessor is to update all output registers in preparation for display of the next frame of data.

The $\overline{\text{EXTNINT 6}}$ interrupt occurs just prior to every fourth vertical blanking pulse in the TV scanning pattern. It is used in this embodiment of the invention as the problem timing or frame rate, and new data, e.g. new rectangle data, is computed at this rate by the microprocessor.

The I3 data word is made up of eight bits which provide the following data to the microprocessor.

BIT 0—Header switch. When set to binary "1", causes the microprocessor to ask for information such as trainee name, date, sky conditions, etc.

BIT 1—Gyro manual. When set to binary "1", indicates that the microprocessor is to use the manual yaw gyro input from the control panel.

BIT 2—Laser range. When set to binary "1", indicates that the microprocessor is to use laser range data.

BIT 3—Manual Range. When set to binary "1", indicates that the microprocessor is to use manual range data from the control panel.

BIT 4—Diagnostic trigger. When set to binary "1", indicates that the microprocessor is to fly a diagnostic missile for test purposes.

BIT 5—Gunner (trainee) trigger. When set to binary "1", indicates that the launch trigger has been depressed and a simulated missile is to be flown.

BIT 6—System Armed. When set to binary "1", indicates to the microprocessor that a gunner trigger will be accepted.

BIT 7—Data valid. When set to binary "1", indicates to the microprocessor that data read from the word 2 multiplexer is valid.

The discrete data word $\overline{\text{DISCRETE 0}}$–$\overline{\text{DISCRETE 7}}$ provides eight bits of data to the microprocessor in normal mode as follows:

BIT 0—Select hit indication

BIT 1—Select missile display at gunner position

BIT 2—(Not used)

BIT 3—Sound on rocket and error tone

BIT 4—Sound off no audio output

BIT 5—Freeze hit TV frame on monitor

BIT 6—Freeze existing TV frame on monitor

BIT 7—Print switch (used by host computer)

In the diagnostic mode the bit assignments for bits 3 through 7 of the discrete data word are the same, but bits 0, 1, and 2 are as follows:

BIT 0—Status missile in flight

BIT 1—Status of timing system

BIT 2—Status of kill zone circuits

Bits 0 and 1 of the discrete data word are used together in the normal mode. When bit 0 is a "1" and bit 1 is an "0", this indicates to the program to display the missile and hit flash if a hit is scored during a flight. When bit 0 is a "0" and bit 1 is a "1", this indicates to the program to blank the missile but display the hit flash if a hit is scored during a flight. If both bits are a 1 both the missile image and hit flash is to be blanked out during a flight. The condition where both bits are "0" is not used.

Bits 4 and 5 of the discrete data word are also used together in normal mode. When bits 4 and 5 are both "0" the error tone and thruster sounds are off. When bit 5 is a "1" and bit 4 is an "0", only the error tone is generated. When bit 5 is an "0" and bit 4 is a "1", both the error tone and thruster sounds are generated. The condition where both bits are "1" is not used.

Bit 3, freeze existing frame, when a "1" indicates to the program to stop the flight of the missile and continue to display on the TV monitor and at the gunner's position the position of the missile and the kill zone as they were when the bit went to a "1".

Bit 6, freeze on Hit bit, when a "1" indicates to the program to stop and display on the TV monitor and at the gunner's position the position of the missile and the kill zone as they were when the missile flew through the plane of the target.

Bit 7, print, when a "1" indicates to the computer that it is to enter a diagnostic data output routine. This is used to allow a host computer to read the contents of the microprocessor memory.

Camera Video Circuit and Video Mixer

The camera video circuit 42 and the video mixer 44 of FIG. 2 are conventional analog circuits that process the video signals produced by the camera 26 and used by the CRT 30. These circuits are illustrated in greater detail in FIGS. 15 and 16.

Figure 15:
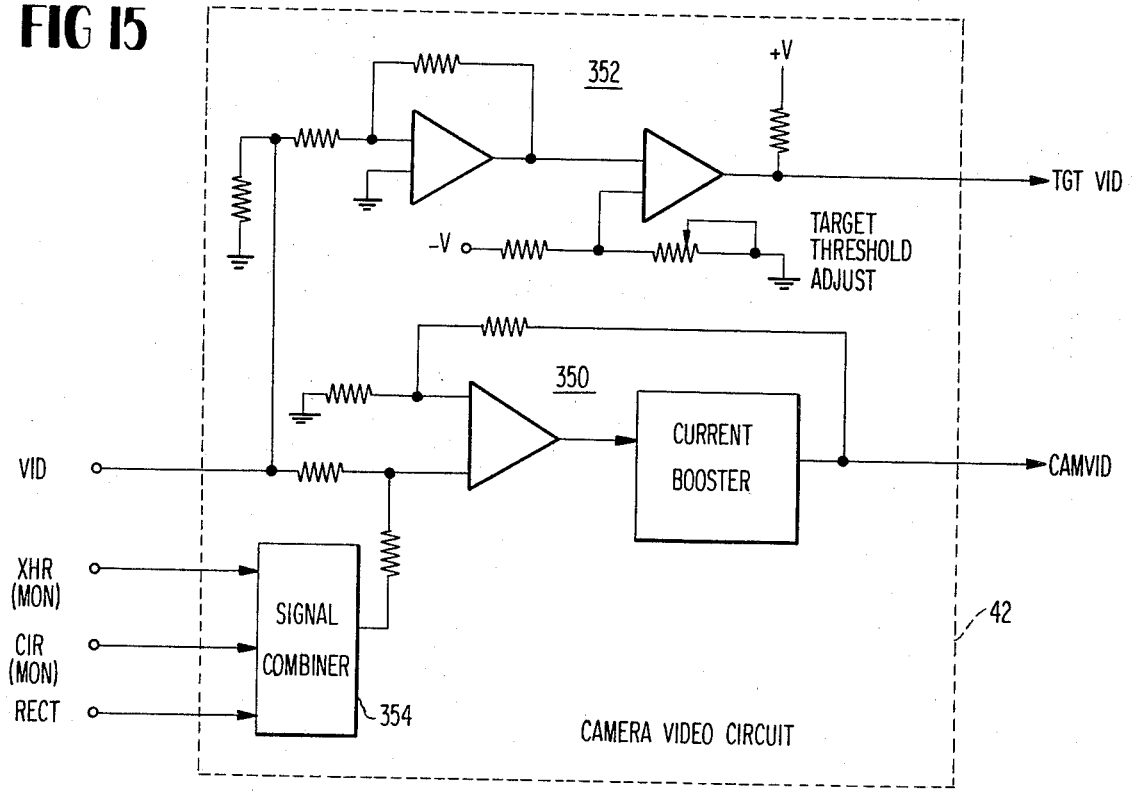

Referring now to FIG. 15, the video signal from the TV camera 26 of FIG. 2 is supplied both to a video amplifier 350 and to an IR target detector 352 in the camera video circuit 42. The output signal from the IR target detector 352 is the target video signal TGTVID that is supplied to the interface electronics unit 36 of FIGS. 2 and 4. The video amplifier 350 supplies the camera video signal CAMVID that is supplied to the TV monitor 19.

The video control signals VCT from the interface electronics unit 36 of FIG. 2 are supplied to a conventional signal combiner 354 and the combined output signal is supplied to the video amplifier 350. The signal combiner 354 receives the monitor cross hairs signal XHR (MON), the monitor circle signal CIRC (MON), the kill zone or rectangle video signal RECTVID, and the vertical TIC signal VTIC. These signals are combined by the signal combiner for further combination with the video signal VIC to form the camera video signal. The IR target detector 352 is a conventional threshold detector that detects signals in the video signal from the camera 26 which are above a predetermined level (determined by the threshold adjust potentiometer) and supplies these signals as the target video signals. Signals above the selected level will be indicative of the detection of infrared lights in the image scan by the TV camera 26. Accordingly, the target video signal TGTVID will be indicative of infrared lights in the scanned field of view.

Figure 16:
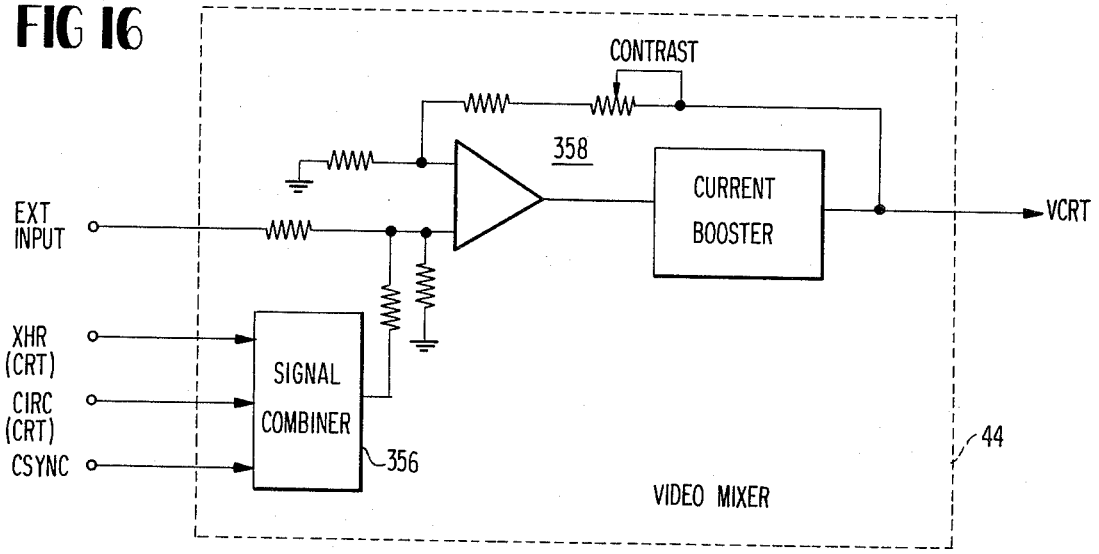

The video mixer of FIG. 16 receives the monitor control signals MCT including the cathode ray tube cross hairs signals XHR (CRT), the cathode ray tube circle signal CIRC (CRT) and the camera sync signals CSYNC (e.g. the verticle and horizontal synchronization signals required to synchronize the TV monitor with the TV camera). A suitable conventional signal combiner 356 in the video mixer combines the cathode ray tube control signals MCT and supplies these signals to a video amplifier 358. The video amplifier may also receive an external input signal for test purposes and the like. The combined video signal is amplified by the video amplifier 358 and supplied to the cathode ray tube 30 as the video cathode ray tube signal VCRT.

Laser Controller

The laser controller 40 of FIG. 2 controls the laser transmitter 38 to transmit a laser signal to the target. The return or echo signal is received by the receiver 38 and is supplied to the laser controller 40 to provide the laser range signal LRNGO-7 that is used by the system as an alternative range measurement. As will be seen hereinafter, range is determined by counting 50 nanosecond intervals between the transmission of the laser pulse and the reception of the echo or return pulse.

Figure 17:
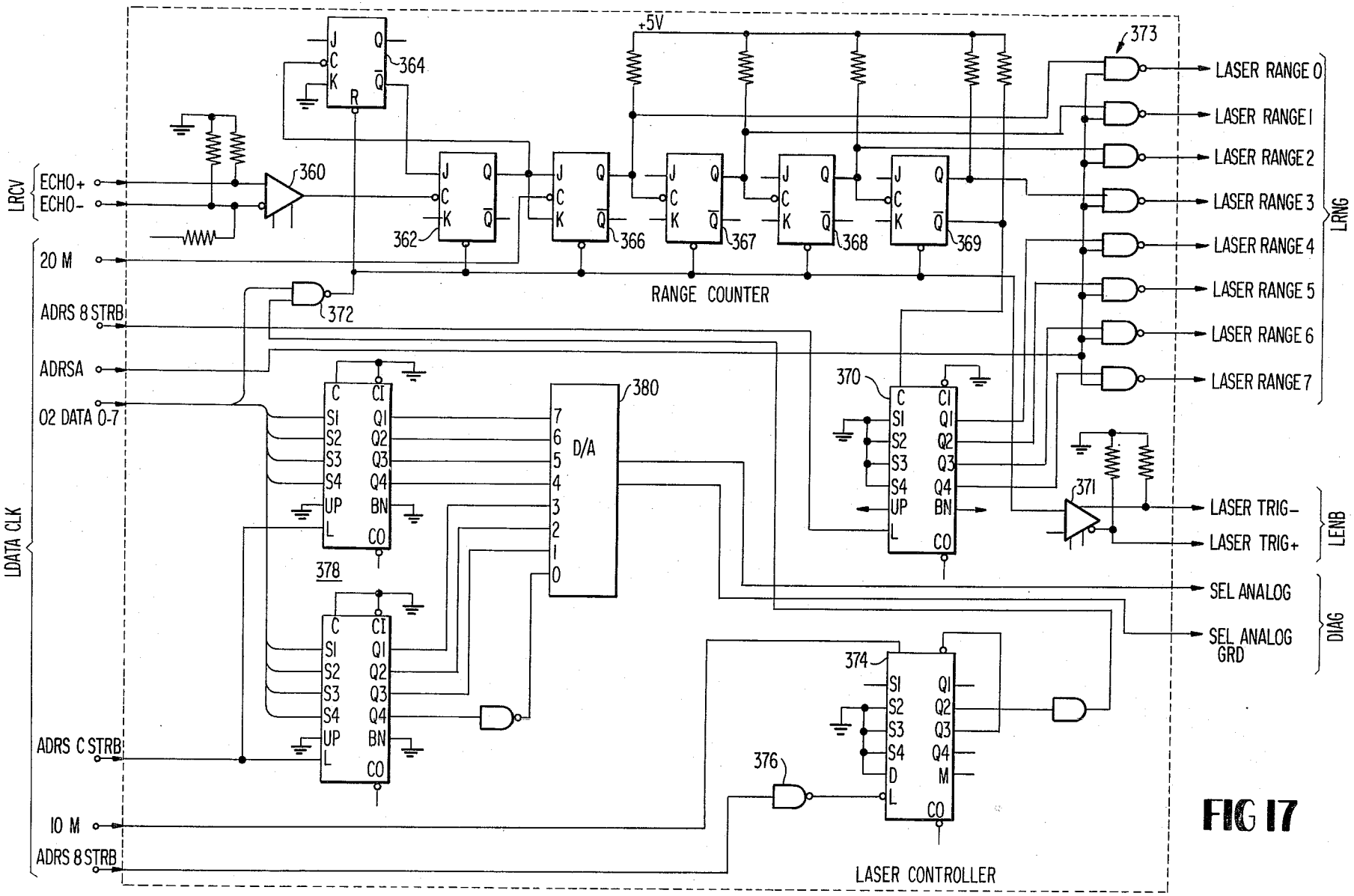

Referring to FIG. 17 wherein the laser controller 40 is illustrated in greater detail, the received laser pulse signal LRCV (ECHO) is shaped by a conventional differential receiver 360 and applied to the clock input terminal C of a J-K flip flop 362. The output signal from the Q output terminal of the flip flop 362 is applied to the clock input terminal C of a J-K flip flop 364 and to the J and K input terminals of a J-K flip flop 366. The flip flop 366 is clocked by the 20M clock signal and is connected serially with three J-K flip flops 367-369 and a counter 370 as illustrated to form an eight stage counter.

All of the flip flops 362-369 are reset by a signal from a NAND gate 372 that receives the 02DAT7 signal on one input terminal and a signal from the Q2 output terminal of a binary counter 374 on the other input terminal. The NAND gate 372 output signal is also supplied to a conventional differential driver amplifier 371 to produce the laser trigger signal LENB. The counter 370 is loaded with a zero count by the ADRS8STRB signal. The 10M clock signal is supplied to the clock input terminal C of the counter 374, and the address 8 strobe signal ADRS8STRB is supplied to the load terminal L of the counter through an inverter 376.

The 02 data word is supplied to a register 378 which is loaded by the address strobe signal ADRS C STRB. The output signals from the register 378 are supplied to a conventional digital to analog (D/A) converter 380 to produce the SELANALOG signal.

In operation, the laser trigger is generated when bit 7 of the 02 data output word is high and the address decoder generates the address 8 strobe. The strobe ADRS8STRB resets the counter 374 to zero and starts it counting. When this counter reaches count of 2, the Q2 output terminal produces a high or binart "1" signal at the input terminal of NAND gate 372 for 200 nanosecond, and if bit 7 of the 02 word is high, a 200 nanosecond pulse is generated at the output of NAND gate 372. This resets the range counter consisting of flip flops 366 through 369, resets control flip flops 362 and 364, and causes the driver amplifier 371 to generate the laser trigger signal.

When counter 374 reaches a count of 4, it inhibits itself from further counting and the inverted output signal from the Q2 terminal low removing the reset signal. At this time, the laser has not yet fired, and the range counter is reset to 0 and not counting because the output signal of flip flop 362 is low which, in turn, is holding the J-K inputs of flip flop 366, the first flip flop in the counter, at a low level. When the laser fires it sends one echo pulse through the amplifier 360 to the control flip flop 362. This pulse toggles flip flop 362 as both its J and K inputs are high. This causes the output signal of flip flop 362 to go high, enabling the range counter to start counting at the 20 megahertz rate. When the second echo pulse arrives, it signals the return of the laser pulse from the target. This pulse again toggles flip flop 362 stopping the range counter. The flip flop 362 also toggels flip flop 364 preventing any additional echo pulses from causing the range counter to count. This gives the system high noise immunity from false alarm signals from the laser.

The resulting counts is stored in the range counter and is entered into the microprocessor through the NAND gates 373 and the multiplexer 68 when address A signal ADRSA is generated by the address decoder.

The range to the target is computed as follows:

Round trip for the laser pulse $=1/F\times N$ SECONDS (where $F=20$ MHz and $N=$count in counter)

Speed of light $=0.982\times10^9$ feet per second.

Range (feet) $=0.982\times10^9\ 1/F\times N$ round trip or $=0.982\times10^9\ N/2F$ one way.

The register 378 and D/A converter 380 are used for diagnostic purposes only. When it is desired to have an analog representation of any 02 data word, the data word is strobed into the register 378 by the ADRSCSTRB signal. The resultant output signal from the D/A converter 380 is thus the analog representation of the 02 data word and may be provided at the control panel 18 for monitoring.

We claim:

1. A weapons simulator for training an operator in the use of a weapons system comprising:

operator positionable optical means for viewing a predetermined field of view;

first and second optically detectable markers positioned on a target remote from said optical means and having a predetermined spacing therebetween;

means in optical communication with said optical means for scanning the field of view in accordance with a predetermined scanning pattern and generating a first video signal representing an image within the field of view including the target and the first and second markers;

means responsive to the video signal from said scanning means for detecting said markers and generating a target signal representing the position of the target in relation to the predetermined scanning pattern;

means for generating a range signal representing the range between the simulator and the target in the field of view;

means for generating a missile guidance signal; operator actuated means for initiating simulated flight;

means responsive to operator initiation of simulated flight for generating a missile signal electronically simultating the flight of a missile from the simulator to the target and varying in value in accordance with the guidance signal and time from initiation of flight to thereby represent the size and location of the missile within the field of view;

means in optical communication with said optical means for projecting an image of the missile onto the image presented to the operator in the optical field of view in response to said missile signal;

means responsive to said target, range and missile signals for generating a kill signal related to the proximity of the target and the simulated missile in the field of view a predetermined time after initiation of the simulated flight.

2. The weapons simulator of claim 1 wherein said optically detectable markers comprise first and second infrared lights, said scanning means comprising a television camera sensitive to the infrared spectrum.

3. The weapons simulator of claim 2 wherein said range signal generating means comprises means responsive to said video signal for generating a spacing signal representing the relative positions of said infrared lights in the scanning pattern of the television camera, and means for calculating the range in response to said spacing signal and known characteristics of said scanning pattern, said field of view, and said predetermined spacing of said infrared lights.

4. The weapons system of claim 1 wherein said range signal generating means comprises means responsive to said video signal for detecting the positions of said markers relative to each other in the image within the field of view, and means for calculating the range between the optical means and the target in response to said detected relative positions.

5. The weapons simulator of claim 1 wherein said range signal generating means comprises laser ranging means for producing said range signal in response to laser energy transmitted to and received as an echo from the target.

6. The weapons system of claim 1 wherein said range signal generating means comprises a manual control for setting an estimated range and producing said range signal in response to said estimated range.

7. The weapons simulator of claim 1 including an audio effects device responsive to said operator initiation of simulated flight and said guidance signal for producing audio effects simulating the launch and guidance thrusters of the missile.

8. The weapons simulator of claim 1 wherein said kill signal generating means comprises means for generating a second video signal defining a rectangular pattern within the field of view, the rectangular pattern being positioned in predetermined relation to the image of said markers in the field of view to define a target kill zone.

9. The weapons simulator of claim 8 wherein said optically detectable markers comprise first and second infrared lights, said scanning means comprising a television camera sensitive to the infrared spectrum.

10. The weapons simulator of claim 9 wherein said range signal generating means comprises means responsive to said first video signal for generating a spacing signal representing the relative positions of said infrared lights in the scanning pattern of the television camera, and means for calculating the range in response to said spacing signal and known characteristics of said predetermined spacing of said infrared lights.

11. A weapons simulator for training an operator in the use of a weapons system comprising:

operator positionable optical means for presenting the operator with an image of a predetermined optical field of view, means in optical communication with said optical means for scanning the field of view in accordance with a predetermined scanning pattern and generating a video signal representing an image within the field of view including a target in the field of view;

means responsive to the video signal from said scanning means for generating a target signal representing the position of the target in the field of view;

means on the simulator for generating a guidance signal in response to the positioning of the optical means;

means for generating a range signal representing the range between the simulator and the target in the field of view;

operator actuated means for initiating simulated flight;

means responsive to operator initiation of simulated flight for generating a missile signal electronically simulating the flight of a missile from the simulator to the target, the missile signal varying in response to the guidance signal and time from initiation of flight to represent the size and location of the missile within the field of view;

means in optical communication with said optical means for projecting an image of the missile onto the image presented to the operator in the optical field of view in response to said missile signal;

means responsive to said target, range and missile signals for generating a kill signal related to the proximity of the target and the simulated missile in the field of view at a predetermined time after initiation of the simulated flight.

12. The weapons simulator of claim 11 wherein said kill signal generating means comprises means for generating a second video signal defining a rectangular pattern within the field of view, the rectangular pattern being positioned in predetermined relation to the image of said markers in the field of view to define a target kill zone.

13. The weapons simulator of claim 11 further including optically detectable markers positioned on said target comprising first and second infrared lights, said scanning means comprising a television camera sensitive to the infrared spectrum.

14. The weapons simulator of claim 13 wherein said range signal generating means comprises means responsive to said video signal for generating a spacing signal representing the relative positions of said infrared lights in the scanning pattern of the television camera, and means for calculating the range in response to said spacing signal and known characteristics of said scanning pattern, said field of view, and said predetermined spacing of said infrared lights.

15. The weapons simulator of claim 14 wherein said kill signal generating means comprises means for generating a second video signal defining a rectangular pattern within the field of view, the rectangular pattern being positioned in predetermined relation to the image of said markers in the field of view to define a target kill zone.

16. A method of simulating the launch and flight of a guided missile to a target in order to train an operator in the use of an operator positionable optical guidance system comprising the steps of:

generating a first video signal representing an image of a field of view beheld by the operator through the optical guidance system by electronically scanning the field of view in accordance with a predetermined scanning pattern;

simulating the launch of a missile toward the target and displaying a simulated missile to the operator in the field of view;

modifying the size of the simulated missile as a function of elapsed time of flight from the launch of the simulated missile;

modifying the location of the simulated missile in the field of view in response to movement of the optical guidance system by the operator;

detecting the target in the video signal and determining the position of the target relative to the scanning pattern;

determining the range from the optical guidance system to the target; and indicating a hit or a miss as a function of the position of the target relative to the location of the simulated missile in the field of view at a total elapsed time of flight that would place the simulated missile at the approximate range of the target.

17. The method of claim 16 wherein the hit or miss is indicated by:

generating a second video signal defining a rectangular area in the field of view within which at least a portion of the target image lies; and generating a hit indication when the simulated missile is located within the rectangular area at said total elapsed time of flight, said miss indication being generated for all other locations of the simulated missile at said total elapsed time of flight.

18. A method of simulating the launch and flight of a guided missile to a target in order to train an operator in the use of an operator positionable optical guidance system comprising the steps of:

generating a first video signal representing an image of a field of view beheld by the operator through the optical guidance system by electronically scanning the field of view in accordance with a predetermined scanning pattern;

simulating the launch of a missile toward the target and displaying a simulated missile to the operator in the field of view;

modifying the size of the simulated missile as a function of elapsed time of flight from the launch of the simulated missile;

modifying the location of the simulated missile in the field of view in response to movement of the optical guidance system by the operator;

determining the range from the optical guidance system to the target by:

detecting in the first video signal two spaced positions of known spacing on the target; and calculating the range to the target as a function of the detected positions, the known spacing, and the predetermined scanning pattern; and indicating a hit or a miss as a function of the target relative to the location of the simulated missile in the field of view at a total elapsed time of flight that would place the simulated missile at the approximate range of the target.

19. A method for calculating the range between a weapons simulator and a remote target comprising the steps of:

transmitting light from two light sources on the target spaced at predetermined distances from each other;

receiving the light from the two light sources on the face of a television camera tube disposed at the location of the weapons simulator;

electronically scanning the face of the television camera tube to generate a television video signal representing light patterns along scan lines on the face of the camera tube;

detecting levels in the video signal representing light from the light sources;

calculating the locations of the detected levels relative to each other in the scan pattern of the camera tube;

calculating the distance to the target in response to the calculated locations of the detected levels.

20. A method for calculating the range between a first location and a second location spaced from said first location comprising the steps of:

transmitting light from two light sources spaced apart a predetermined distance within a common substantially vertical plane disposed at said first location:

receiving the light transmitted from the two light sources with a scanned light detector disposed at said second location to develop a video signal representing light levels along a scanning pattern of the light detector;

determining the distance within the scanning pattern between levels in the video signal representing light received from the two light sources by counting the number of scan lines between the two light sources in the scanning pattern; and calculating the distance between the first and second spaced locations in response to the distance within the scanning pattern between the levels representing light received from the two light sources.

21. A weapons simulator for training an operator in the use of a weapons system comprising:

operator positionable optical means for presenting the operator with an image of a field of view;

means in optical communication with said optical means for scanning the field of view and generating a video signal representing an image within the field of view including a target in the field of view;

means responsive to the video signal from said scanning means for generating a target signal representing the position of the target in the field of view;

means on the simulator for generating a guidance signal in response to the positioning of the optical means;

means for initiating simulated flight;

means responsive to initiation of simulated flight for generating a missile signal simulating the flight of a missile from the simulator to the target, the missile signal varying in response to the guidance signal to represent the location of the missile within the field of view;

means in optical communication with said optical means for projecting an image of the missile onto the image presented to the operator in the field of view in response to said missile signal; and means responsive to said target and missile signals for generating a hit signal related to the proximity of the target and the simulated missile in the field of view at a predetermined time after initiation of the simulated flight.

22. A method of simulating the flight of a guided missile to a target in order to train an operator in the use of an operator positionable optical guidance system comprising the steps of:

electronically scanning the field of view including a target generating a video signal representing an image of a field of view beheld by the operator through the optical guidance system during said electronic scanning step generating and displaying a simulated missile to the operator in the field of view;

modifying the location of the simulated missile in the field of view in response to movement of the optical guidance system by the operator; and indicating a hit or a miss as a function of the target relative to the location of the simulated missle in the field of view.

* * * * *